US006428671B1

(12) United States Patent
Sogo et al.

(10) Patent No.: US 6,428,671 B1
(45) Date of Patent: Aug. 6, 2002

(54) METHOD AND APPARATUS FOR ELECTRO-COAGULATION PRINTING AND ELECTRODE CONTROL UNIT

(75) Inventors: Akira Sogo, Kawasaki; Masao Noro, Hamamatsu; Kunimasa Muroi, Hamamatsu; Koji Toda, Hamamatsu, all of (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/613,945

(22) Filed: Jul. 11, 2000

(30) Foreign Application Priority Data

Jul. 13, 1999 (JP) ..... 11-199583

(51) Int. Cl.[7] ..... C25D 13/00

(52) U.S. Cl. ..... 204/623; 101/DIG. 29; 101/DIG. 37

(58) Field of Search ..... 204/623, DIG. 29, 204/DIG. 37

(56) References Cited

U.S. PATENT DOCUMENTS

| | | | | |
|---|---|---|---|---|
| 4,895,629 A | | 1/1990 | Castegnier et al. | |
| 5,942,094 A | * | 8/1999 | Castegnier et al. | 204/623 |
| 6,190,527 B1 | * | 2/2001 | Hashimoto et al. | 204/623 |

FOREIGN PATENT DOCUMENTS

| | | |
|---|---|---|
| EP | 0409570 | 1/1991 |
| EP | 0922586 | 6/1999 |
| JP | 11-91158 | 4/1999 |
| JP | 11-320946 | 11/1999 |

OTHER PUBLICATIONS

European Search Report issued Oct. 19, 2000 in a related application.

* cited by examiner

*Primary Examiner*—Kishor Mayekar
(74) *Attorney, Agent, or Firm*—Dickstein, Shapiro, Morin & Oshinsky LLP

(57) ABSTRACT

An electro-coagulation printer uses an electrode control unit to drive electrodes which are aligned in proximity to a rotation drum having a conductive ink film on its surface. The electrodes are respectively electrified to partially coagulate the conductive ink film to form ink dots on the surface of the rotation drum, so that the ink dots are transferred onto a paper. Herein, the electrode control unit receives print data from a host device by way of an interface. Gradation data representing gradation values for one line of the electrodes are created based on the print data and are output in a serial manner. The serial gradation data are converted to parallel data corresponding to the gradation values, which are held and controlled in output timing. Based on the gradation values, pulse signals are generated to drive the electrodes respectively.

17 Claims, 34 Drawing Sheets

FIG.4A LINE TIMING SIGNAL

FIG.4B CLOCK SIGNAL

FIG.4C LINE DATA (0000~1FFF)

P1
P2
LINE TIMING SIGNAL
CLOCK SIGNAL
LINE DATA (NUMBER) (GRADATION)
1FFC "00"
1FFD "40"
1FFE "C0"
1FFF "FF"
0000 "03"
0001 "AC"
0400 "6"
0401 "9B"
0C00 "F3"
0C01 "D9"
0FF0 "8A"
0FF1
1FFF "82"
0000 "19"
PULSE SIGNAL (#1FFF)
PULSE SIGNAL (#1FFE)
PULSE SIGNAL (#1FFD)
PULSE SIGNAL (#1FFC)
PULSE SIGNAL (#0000)

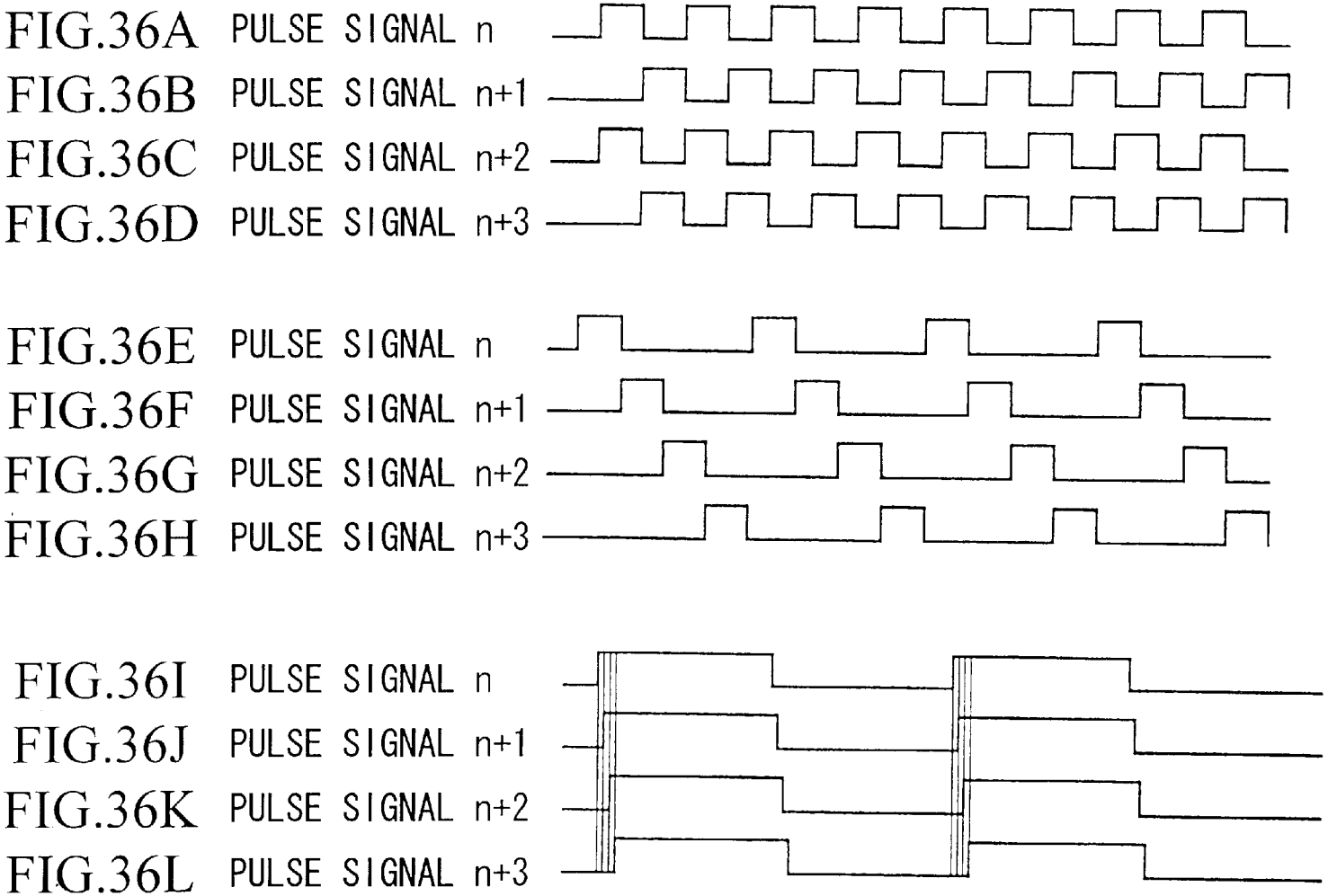
FIG.36A PULSE SIGNAL n
FIG.36B PULSE SIGNAL n+1
FIG.36C PULSE SIGNAL n+2
FIG.36D PULSE SIGNAL n+3
FIG.36E PULSE SIGNAL n
FIG.36F PULSE SIGNAL n+1
FIG.36G PULSE SIGNAL n+2
FIG.36H PULSE SIGNAL n+3
FIG.36I PULSE SIGNAL n
FIG.36J PULSE SIGNAL n+1
FIG.36K PULSE SIGNAL n+2
FIG.36L PULSE SIGNAL n+3

METHOD AND APPARATUS FOR ELECTRO-COAGULATION PRINTING AND ELECTRODE CONTROL UNIT

BACKGROUND OF THE INVENTION

1. Field of the Invention

This invention relates to methods and apparatuses for electro-coagulation printing in which electrodes are electrified to partially coagulate conductive ink films to form ink dots on surfaces of rotation drums, from which the ink dots are transferred onto papers. This invention also relates to electrode control units used for controlling the electrodes.

This application is based on Patent Application No. Hei 11-199583 filed in Japan, the content of which is incorporated herein by reference.

2. Description of the Related Art

Recently, engineers develop electro-coagulation-type printers (hereinafter, referred to as electro-coagulation printers) using conductive ink, which operate as follows:

Conductive ink films are formed on surfaces of rotation drums, which are made of metal materials. Applying electricity between the electrodes and rotation drums, conductive ink films are partially coagulated to form ink dots on the surfaces of the rotation drums, from which the ink dots are transferred onto papers to form desired print patterns (e.g., images and characters).

For example, Japanese Unexamined Patent Publication No. Hei 11-91158 discloses a fine pitch electrode unit used for the electro-coagulation printer, which will be described with reference to FIGS. 37A to 37C. FIG. 37A shows essential parts of the electro-coagulation printer. FIG. 37B shows an example of ink dots being coagulated by applying electricity to electrodes. FIG. 37C shows an configuration of the fine pitch electrode unit containing LSI chips (or LSI circuits).

In general, the electro-coagulation printers correspond to a direct print system which does not require a printing plate. So, the electro-coagulation printers have an advantage in that a number of prints can be made uniformly and clearly at a high speed. As shown in FIG. 37B, electrified coagulation is effected on each of ink dots being arranged on a surface of a rotation drum 201 by applying electricity to electrodes of a fine pitch electrode unit 101. Due to electricity being applied to prescribed electrodes which are aligned in proximity to the rotation drum 201, ink dots are adequately condensed and solidified, while ink corresponding to other electrodes which are not electrified remain without being condensed and solidified. Then, image revealing is effected to remove the ink which is not condensed and solidified, so that an image is formed by solidified ink dots, which are transferred onto a paper (or papers). Thus, it is possible to perform high-speed printing. Because the electro-coagulation printer performs printing using ink without using the printing plate and without using photosensitive members and toner, it is possible to reduce printing cost per one sheet of print.

The fine pitch electrode unit 101 has a number of electrodes 101*a* to effect electrified coagulation with respect to ink dots. As shown in FIG. 37B, each of the electrodes 101*a* has a cylindrical shape whose diameter is "d", while the electrodes 101*a* are arranged to adjoin each other with a prescribed pitch "S". Herein, both the diameter d and the pitch S are designed to have fine dimensions which are units of micro-meters ($\mu$m).

FIG. 37C shows an outline of the fine pitch electrode unit 101. The fine pitch electrode unit 101 is equipped with a fine pitch electrode section 140A including a prescribed number of fine electrodes 101*a,* which are aligned in a single line on a same plane and which are bared or exposed. A printed-circuit board 141 has the fine pitch electrode section 140*a* as one terminal end thereof. Electrode drive circuits 142 which are LSI chips or else are mounted on the printed-circuit board 141. The printed-circuit board 141 is also equipped with connectors 143 for inputting drive commands given from the external (e.g., external system or device) with respect to the electrode drive circuits 142. Printed wiring lines are laid on the printed-circuit board 141 and interconnect the aforementioned parts and components to enable operations independently. The fine pitch electrode unit shown in FIG. 37C is designed to collectively drive the prescribed number of electrodes.

Next, an example of an electrode driving method will be described with reference to FIGS. 38A to 38C. FIG. 38A shows that thirty-two electrodes are switched over and driven respectively. Herein, every thirty-two electrodes are grouped in connection with a full print width of a dot-matrix format, for example. The thirty-two electrodes are supplied with a pulse signal (see FIG. 38B) consisting of pulses whose pulse widths represent gradation values. Herein, every single electrode within the thirty-two electrodes is designated by a switch 145 and is driven according to needs. The fine pitch electrode unit as a whole includes input lines, a number of which is calculated by N÷32 (where "N" denotes a total number of electrodes). Hence, those input lines are respectively connected to switches (145), each of which is provided for a group of thirty-two electrodes.

In the above, print information (i.e., pulse signal) is supplied to each group of thirty-two electrodes in a serial manner by which the electrodes are being driven at sequentially different timings. This causes unwanted deviations in print positions of dots as shown in FIG. 38C.

In addition, the aforementioned fine pitch electrode unit is designed to drive the electrodes in response to analog signals. For this reason, it is difficult to adjust relationships between actual printing densities and gradation values corresponding to print data. In the case of color printing, it is difficult to adjust print positions among different colors of ink. That is the aforementioned electro-coagulation printer needs a mechanical installation accuracy to be strictly maintained among mechanical parts such that the electrodes are strictly aligned in a prescribed direction while maintaining a constant gap being formed between the electrodes and rotation drum. In other words, there is a drawback in that the conventional electro-coagulation printer cannot perform high-quality printing without strictly maintaining the mechanical installation accuracy among the mechanical parts.

SUMMARY OF THE INVENTION

It is an object of the invention to provide a method and an apparatus for electro-coagulation printing in which printing is performed with a high quality and at a high speed.

It is another object of the invention to provide an electrode control unit which is suited to the electro-coagulation printing method and apparatus.

A printing method of this invention for an electro-coagulation printer is realized by a print data reception step, a gradation data creation step, a parallel conversion step, a gradation value hold step, a parallel drive control step and an electrode drive step. Herein, the gradation data creation step creates gradation data representing gradation values for one line of pixels on the basis of the print data received by the print data reception step. The parallel conversion step receives the gradation data which are serially transferred thereto to parallel data corresponding to the gradation values with respect to one line of electrodes, which are aligned in proximity to a rotation drum having a conductive ink film on its surface. After the gradation value hold step completely holds one line of the gradation values, the parallel drive control step simultaneously outputs the gradation values in parallel to the electrode drive step to drive the electrodes respectively. Driving the electrodes, the conductive ink film is partially coagulated to form ink dots on the surface of the rotation drum, so that the ink dots are transferred onto a paper.

In the above, the gradation value can be configured using an arbitrary number of bits. If the gradation value is represented by eight bits, there are provided 256 steps of gradation. Incidentally, the gradation value can be configured by a single bit, in which digit 0 designates a blank (or white dot) while digit 1 designates a black dot. In the parallel conversion step, the gradation values serially input are output onto a parallel bus including lines for the electrodes respectively, so that one line of the gradation values are converted to parallel data. The printer waits for the timing when the gradation value hold step completely holds one line of the gradation values. Then, the parallel drive control step simultaneously outputs the gradation values in parallel so that the electrode drive step simultaneously drives the electrodes. Thus, it is possible to secure linearity in printing in an alignment direction of the electrodes. The electrode drive step performs drive controls independently on the electrodes based on the gradation values. So, it is possible to independently correct the timings of driving the electrodes with ease. Therefore, it is possible to cope with positional deviations that occur in installation positions of the electrodes. That is, those deviations can be absorbed by changing destinations of the gradation values with respect to the electrodes respectively or by correcting output timings of the gradation values. Inputting the gradation values in parallel, the electrode drive step independently drives the electrodes based on the gradation values. Hence, it is possible to correct the gradation values independently with respect to the electrodes with ease. That is, it is possible to easily correct the electrodes being driven in accordance with relationships between gradation values and actual printing densities.

An electro-coagulation printer of this invention is basically constructed using electrodes which are aligned in proximity to a rotation drum having an conductive ink film on its surface. Hence, the electrodes are electrified to partially coagulate the conductive ink film to form ink dots on the surface of the rotation drum, so that the ink dots are transferred onto a paper. The electro-coagulation printer is characterized by providing an interface, a data processing section, an output timing control section, a pulse generation section and an electrode drive section. Herein, the data processing section creates gradation data corresponding to a collection of gradation values for pixels on the basis of print data received by the interface. The output timing control section controls timings of outputting the gradation values in parallel with respect to one line of the electrodes independently. The pulse generation section generates pulse signals in response to the gradation values which are output by the timings being independently controlled by the output timing control section. Using the pulse signals, the electrode drive section drives the electrodes in parallel.

In the above, when print data are input to the interface, the data processing section specifies gradation values for pixels respectively on the basis of the print data. The output timing control section controls output timings for one line of gradation values independently. Herein, the gradation values are output with delays which are determined in consideration of installation positions of the electrodes. The pulse generation section converts the gradation values independently input thereto to pulse signals. Using the pulse signals, the electrode drive section drives the electrodes respectively, so that the electrodes are independently driven in parallel. Thus, it is possible to improve linearity in printing. If the electrodes are uniformly aligned in a straight line, they are simultaneously driven. If the electrodes are aligned with small positional deviations in installation, they are driven based on the pulse signals at specific timings which are designated in response to the positional deviations. Thus, it is possible to secure linearity in high-speed printing in an alignment direction of the electrodes by absorbing differences among the installation positions of the electrodes. In addition, signal processing is adequately performed to absorb positional shifts of electrodes which are respectively aligned for different colors in color printing or differences of gaps measured between the electrodes and rotation drum in printing with shading. So, it is possible to improve quality in printing. In addition, the pulse generation section converts the gradation values to pulse signals respectively. So, it is possible to easily perform corrections on the gradation values or pulse signals in accordance with relationships between the gradation values and actual printing densities. Those corrections can be performed with linearity being maintained in printing.

BRIEF DESCRIPTION OF THE DRAWINGS

These and other objects, aspects and embodiments of the present invention will be described in more detail with reference to the following drawing figures, of which:

FIG. 36A shows a pulse signal n having a first phase being generated for driving an electrode #n;

FIG. 36B shows a pulse signal n+1 having a second phase being generated for driving an electrode #n+1;

FIG. 36C shows a pulse signal n+2 having the first phase being generated for driving an electrode #n+2;

FIG. 36D shows a pulse signal n+3 having the second phase being generated for driving an electrode #n+3;

FIG. 36E shows a pulse signal n having a prescribed phase;

FIG. 36F shows a pulse signal n+1 whose phase differs from the prescribed phase;

FIG. 36G shows a pulse signal n+2 whose phase further differs from the prescribed phase;

FIG. 36H shows a pulse signal n+3 whose phase still further differs from the prescribed phase;

FIG. 36I shows a pulse signal n consisting of pulses;

FIG. 36J shows a pulse signal n+1 consisting of pulses whose leading edges are delayed;

FIG. 36K shows a pulse signal n+2 consisting of pulses whose leading edges are further delayed;

FIG. 36L shows a pulse signal n+3 consisting of pulses whose leading edges are still further delayed.

DESCRIPTION OF THE PREFERRED EMBODIMENTS

Figure 1:
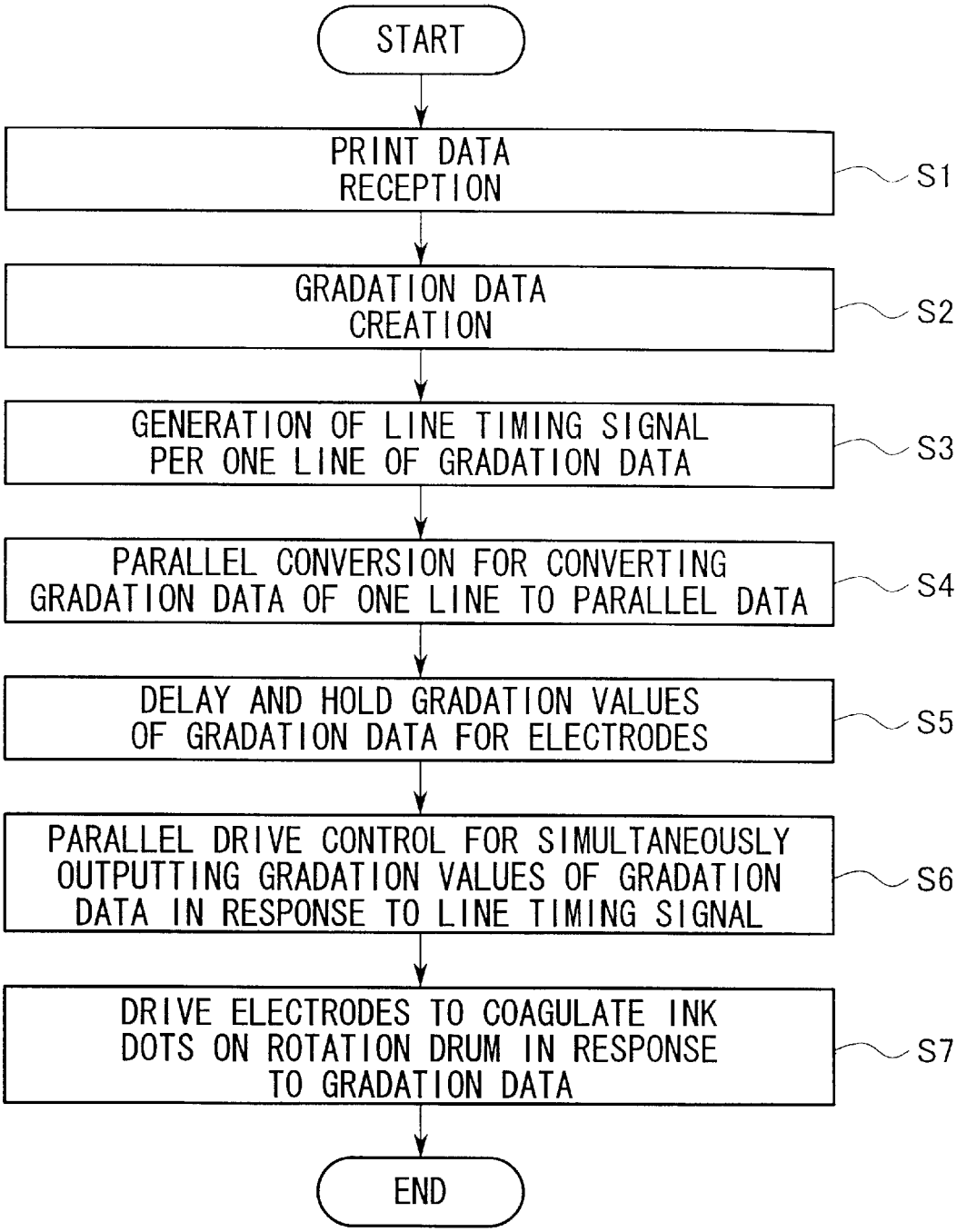
FIG. 1 is a flowchart showing operations of a printing method in accordance with a first embodiment of the invention.

This invention will be described in further detail by way of examples with reference to the accompanying drawings.

The preferred embodiments of this invention describe an electro-coagulation printer which has 8192 electrodes in one line across a prescribed width thereof, wherein gradation data is given by eight bits to represent 256 steps for gradation, for example. Such gradation data are supplied to a parallel bus consisting of 8192 lines corresponding to the 8192 electrodes respectively. So, it is necessary to provide a parallel conversion step, which is followed by a gradation value hold step. The gradation value hold step is provided to hold each of gradation values, which are produced by the parallel conversion step. For example, latch circuits are used to hold the gradation values. In addition, it is preferable to maintain linearity in printing in an alignment direction of aligning the electrodes by holding a prescribed number of gradation values corresponding to one line of print. Concretely speaking, the latch circuits hold 8192 gradation values, for example. In a parallel drive step, the 8192 gradation values held in the latch circuits are simultaneously converted to pulse signals. Concretely speaking, the gradation values are used as address signals being supplied to an EEPROM (an abbreviation for "Electrical-Erasable Programmable Read-Only Memory") storing pulse patterns, which are being adequately output, for example. Herein, each of the pulse patterns is defined as a pulse signal having a pulse width which is proportional to the gradation value or a pulse signal having pulses, a number of which is proportional to the gradation value. Or, it is defined as a pulse signal which is varied in response to a print density characteristic of an electrode. In the electrode drive step, the pulse signal is processed by positive/negative inversion and/or amplification. So, electricity is applied to the electrode in response to a pulse width of the pulse signal being processed or in response to a number of pulses contained in the pulse signal being processed. Thus, it is possible to form ink dots in response to the gradation values.

A printing method using the aforementioned steps is applicable to a prescribed type of printers, which operate as follows:

A conductive ink film is held on a surface of a rotation drum. Electricity is applied to prescribed electrodes to partially coagulate the ink film, so that ink dots are being formed on the rotation drum. A transfer section transfers the ink dots of the rotation drum onto a paper. Incidentally, conductive ink is used for the ink film, so that a prescribed image is transferred onto the paper after removal of the ink film other than the ink dots which are coagulated by the prescribed electrodes.

The printer is equipped with an electrode control unit that drives and controls the electrodes in response to gradation data corresponding to print data being transmitted thereto from a host system. The electrode control unit can be actualized using LSI circuits. Or, it can be partially actualized using a CPU that runs programs.

It is possible to employ various techniques for generation of pulses based on gradation values. That is, the pulses are produced with reference to the EEPROM storing the pulse patterns. Or, they are produced by modulation techniques. A pulse width can be controlled in response to a number of clock pulses which are counted by the CPU, for example. In the case of the pulse patterns, it is possible to produce pulse signals of arbitrarily selected waveshapes with ease. That is, the pulse signal is controlled such that a number of pulses is determined in proportion to the gradation value or a number of pulse is corrected by the gradation value. In the case of the modulation techniques, it is possible to uniformly allocate a prescribed number of pulses, which depends on the gradation value, within one cycle for driving the electrode. It is preferable for the present embodiment to employ the technique which does not cause time differences such as delays by the gradation values, based on which the pulse signals are being produced. In addition, the pulse signal is not necessarily made by voltage variations, so it can be made by current variations. A decision whether to use either the voltage variations or current variations depends on a configuration of an electrode drive circuit.

As described above, the pulse signals are produced by the prescribed technique. Then, the electrode drive circuit turns on electricity to the prescribed electrodes based on the pulse signals. Normally, the pulse signals are at prescribed voltage of 5 V. It is possible to use amplification of transistors to cope with high drive voltage which is higher than 5 V. If the rotation drum is placed in positive potentials, it is possible to inverse the pulse signals in polarities. In addition, it is possible to set amplification factors for the pulse signals against power source voltage in response to amounts of electric power, which is actually applied to the electrodes and which depend upon types of ink and/or types of electrodes. Generally speaking, constant current drive is used for driving the electrodes. Or, it is possible to use constant voltage drive or switched-capacitor drive for driving the electrodes. Or, it is possible to control the electrodes in an analog manner. That is, the gradation values whose output timings are being controlled are directly input to a digital-to-analog converter to produce analog signals, based on which the electrodes are being driven and controlled in parallel.

In addition to the aforementioned basic functions of the printer, it is possible to use additional functions for adjustments and corrections, as follows:

(i) Actual print density is measured to produce a density value. Correction is made on a relationship between the density value and gradation value.

(ii) Adjustment is made on print positions in a paper-feed direction or an alignment direction of electrodes.

(iii) Correction is made on the gradation values or pulse signals in response to deviations in attaching positions of the electrodes or nonuniformity in characteristics of the electrodes.

The aforementioned corrections (or adjustment) are made based on correction information, which is produced by a correction device that measures the density value and linearity in printing. Herein, it is possible to use correction information regarding print characteristics (e.g., relationships between gradation values and print densities) between designated types of ink and print papers, which are publicized by ink manufacturing companies, paper manufacturing companies or printing press manufacturing companies. Herein, it is possible to obtain the correction information, which is provided by host devices or which is downloaded to memories (e.g., EEPROMs) from FTP servers (where "FTP" is an abbreviation for "File Transfer Protocol") by way of Internet, for example. Thus, it is possible to update contents of the correction information.

Now, embodiment of this invention will be described with reference to the drawings.

[A] First Embodiment

FIG. 1 is a flowchart showing an example of operations for a printing method in accordance with a first embodiment of the invention. The printing method of the first embodiment is started by a print data reception step S1 for receiving print data, which is followed by a gradation data creation step S2. The gradation data creation step S2 serially produces gradation data having gradation values for pixels per one line on the basis of the received print data. A line timing signal generation step S3 generates a line timing signal for starting creation of gradation data for a next line after the gradation data are completely produced with respect to one line (i.e., a previous line) in step S2. A parallel conversion step S4 converts the gradation data whose gradation values are serially produced by the gradation data creation step S2 to parallel data corresponding to gradation values, a number of which depends on the prescribed number of electrodes being installed in the electrode control unit. A gradation value hold step S5 holds the "parallel" gradation values which are produced by the parallel conversion step S4. After the gradation value hold step S5 completely holds the gradation values of one line, a parallel drive control step S6 output them simultaneously. Then, an electrode drive step S7 drives the electrodes based on the gradation values output from the parallel drive control step S6, so that ink dots are coagulated at selected positions on the rotation drum being opposite to the "driven" electrodes.

In the aforementioned printing method of FIG. 1, the parallel drive control step S6 simultaneously outputs the gradation values for the electrodes. This indicates that the electrodes are driven by substantially the same timing. Thus, it is possible to improve linearity in printing in the alignment direction of the electrodes.

Figure 2:
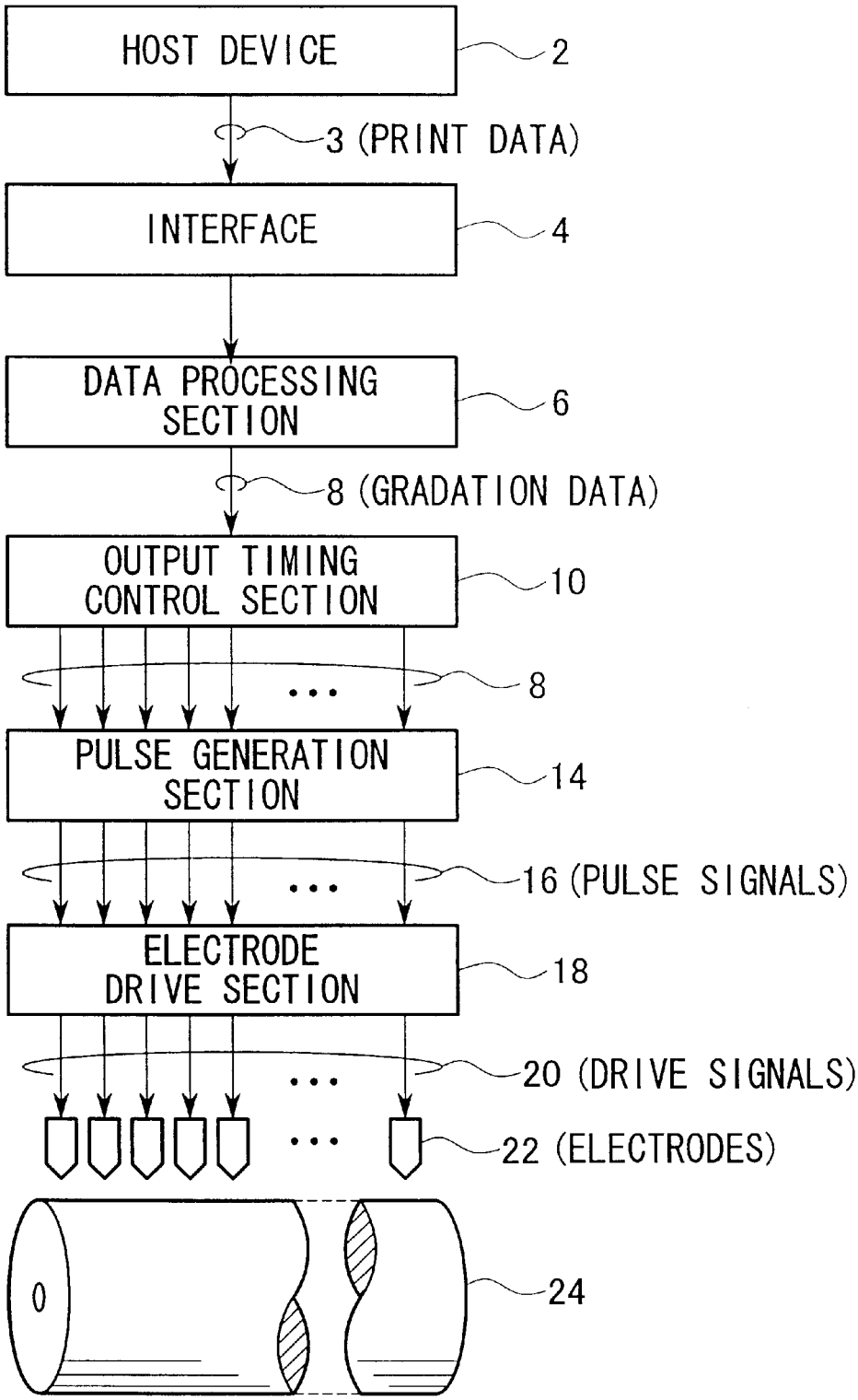
FIG. 2 is a block diagram showing an outline configuration of a printer of this invention.

FIG. 2 is a block diagram diagrammatically showing a configuration of a printer that is preferable for actualization of the aforementioned printing method of FIG. 1. The printer of FIG. 2 is basically configured by a rotation drum 24 and a number of electrodes 22. Herein, the rotation drum 24 has a conductive ink film on a surface thereof. By being electrified, the electrodes 22 coagulate the conductive ink film at selected parts to form ink dots on the rotation drum 24. In addition, the printer is equipped with a transfer section (not shown) which transfers the ink dots onto a paper. The printer is connected with a host device 2 such as an external device. So, the printer receives print data 3 transmitted from the host device 2 by means of an interface 4. The printer contains a data processing section 6 and an output timing control section 10. The data processing section 6 specifies gradation values for pixels based on the print data 3 which are received by the interface 4. The data processing section 6 outputs gradation data 8 corresponding to a collection of the gradation values for the pixels. The output timing control section 10 inputs the gradation data 8 from the data processing section 6 to control output timings of the gradation values to the electrodes per one line.

Figure 3:
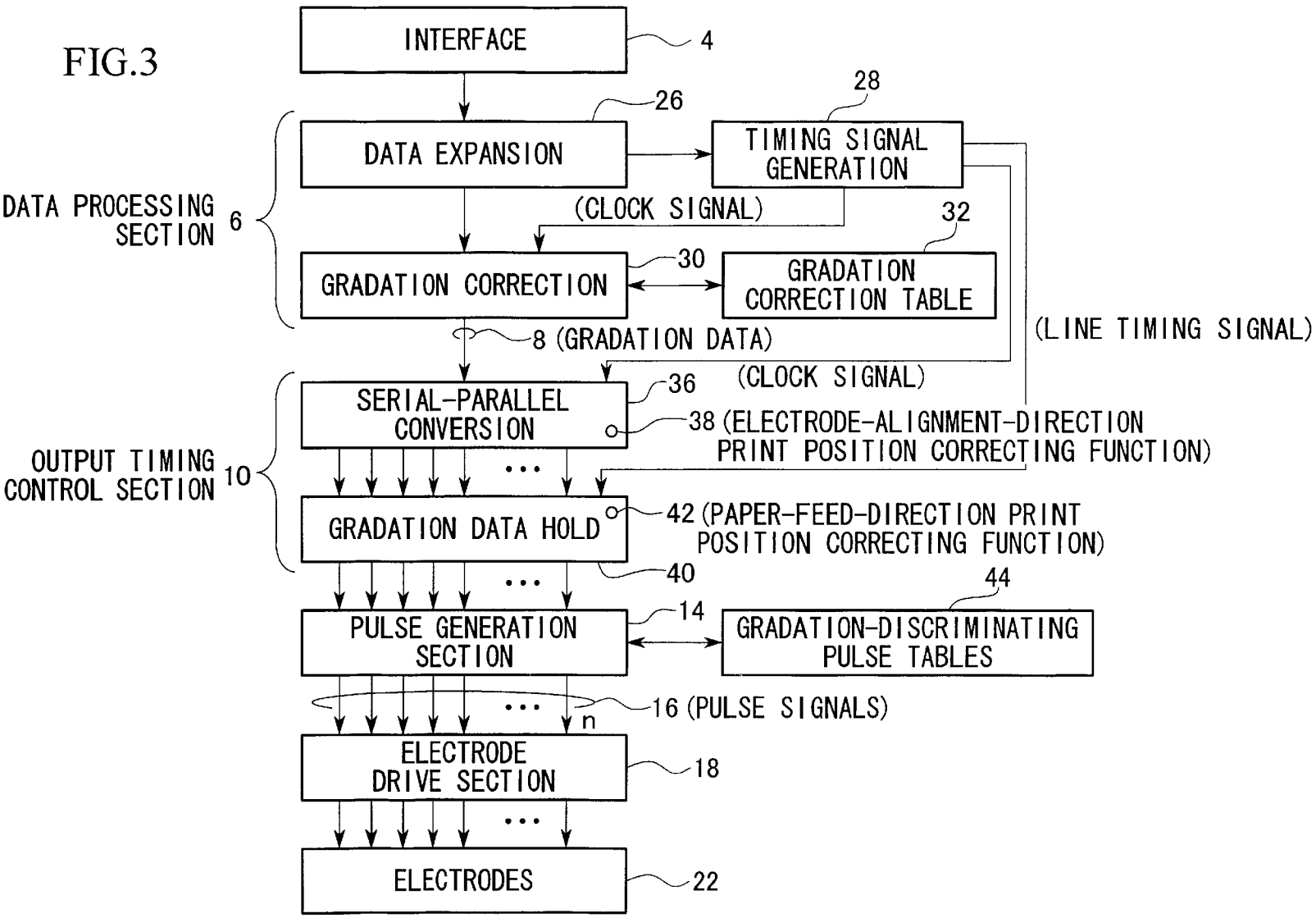
FIG. 3 is a block diagram showing a configuration of an electrode control unit used for the printer shown in FIG. 2.

FIG. 3 shows details of the electrode control unit. The electrode control unit of the present embodiment installs a pulse generation section 14 and an electrode control section 18 therein. The pulse generation section 14 generates pulse signals independently for driving electrodes 22 on the basis of the gradation values, which are output by the prescribed output timings being controlled by the output timing control section 10. The electrode drive section 18 simultaneously drives the electrodes 22 on the basis of the pulse signals generated by the pulse generation section 14.

The interface 4 installs a connector, a communication control section and a reception buffer therein. The interface 4 is connected to the host device 2 or correction device by the connector. The communication control section controls communications being effected between the host device 2 and the interface 4 of the printer. The reception buffer temporarily stores print data, which are received by communications being established by the communication control section.

The data processing section 6 installs a data expansion block 26 and a timing signal generation block 28 therein. The data expansion block 26 expands the print data to produce the gradation data. The timing signal generation block 28 generates a variety of timing signals, as follows:

(i) A clock signal being supplied to a serial-parallel conversion block 36.

(ii) A frame timing signal designating a start of a frame of gradation data.

(iii) A line timing signal designating a start of a line, which is supplied to a gradation data hold block 40.

It is preferable that the data processing section 6 further installs a gradation correction block 30 which corrects gradation values of the print data in response to actual printing densities realized by the electrodes 22. Herein, the gradation correction block 30 refers to a gradation correction table 32, storing relationships between gradation values of print data and "corrected" gradation values, to perform corrections in the case of "nonlinear" printing characteristics (or nonlinear relationships between gradation values and actual printing densities) regarding shading in printing (i.e., gray-scale). The gradation correction block 30 is not necessarily designed to perform gradation corrections directly on the gradation values of the print data. That is, it is possible to perform gradation corrections in connection with pulse signals created for the electrodes. In this case, the pulse generation section 14 is connected with gradation-discriminating pulse tables 44, each of which is provided for each of gradation values, for example. So, the pulse generation section 14 creates pulse signals with reference to the gradation-discriminating pulse tables 44.

Figure 4:
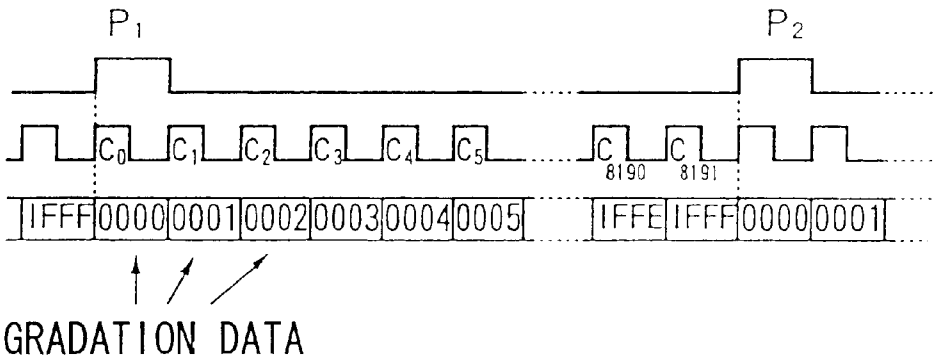
FIG. 4A is a time chart showing a line timing signal being generated inside of the electrode control unit.
FIG. 4B is a time chart showing a clock signal being generated inside of the electrode control unit.
FIG. 4C is a time chart showing line data consisting of gradation data being created based on print data in the electrode control unit.

FIGS. 4A, 4B and 4C show relationships between a line timing signal consisting of line timing pulses, a clock signal consisting of clock pulses and line data. A line of line data contain a set of gradation data showing gradation values for all the electrodes aligned. Herein, each gradation data consists of eight bits showing 256 steps of gradation with respect to each electrode. Because the present embodiment provides 8192 electrodes in total, one line of line data contains 8192 gradation data, which are represented in hexadecimal notation by "#0000" to "#1FFF". Outputting the line data is controlled by line timing pulses and clock pulses. When the timing signal generation block 28 generates a line timing pulse, the gradation correction block 30 outputs line data to the serial-parallel conversion block 36 such that one gradation data is output in response to one clock pulse.

The timing signal generation block 28 sequentially generates clock pulses $C_0$ to $C_{8191}$ during a period of time between two line timing pulses $P_1$ and $P_2$. That is, when the timing signal generation block 28 generates a line timing pulse $P_1$, it simultaneously generates a clock pulse $C_0$, based on which the gradation correction block 30 outputs gradation data for an electrode #0000. The clock pulse $C_0$ is followed by a clock pulse $C_1$, based on which the gradation correction block 30 outputs gradation data for an electrode #0001. Such operations are repeatedly performed with respect to all electrodes, so that the gradation correction block 30 outputs one gradation data every time the timing signal generation block 28 generates a clock pulse. Lastly, the timing signal generation block 28 generates a clock pulse $C_{8191}$, based on which the gradation correction block 30 outputs gradation data for an electrode #1FFF. After generation of the clock pulse $C_{8191}$, the timing signal generation block 28 starts to generate a line timing signal $P_2$ for a next line. Hence, the gradation correction block 30 proceeds to operations of outputting next line data for the next line.

As described above, the data processing section 6 serially outputs the gradation data 8 as the line data to the output timing control section 10. The output timing control section 10 installs the serial-parallel conversion block 36 and the gradation data hold block 40 therein. The serial-parallel conversion block 36 converts the gradation data 8 to parallel data consisting of a number of data which corresponds to the number of the electrodes. That is, the serial-parallel conversion block 36 outputs a number of gradation values in a parallel manner. The gradation data hold block 40 holds the gradation values until their output timings. As described above, the output timing control section 10 is designed such that serial data are converted to parallel data, which are temporarily and independently held. Thus, it is possible to simultaneously drive the electrodes.

It is preferable that the output timing control section 10 installs an electrode-alignment-direction print position correcting function 38 for correcting print positions in the alignment direction of the electrodes and a paper-feed-direction print position correcting function 42 for correcting print positions in a paper-feed direction. Details of those functions 38, 42 will be described later. Due to provision of those functions, even if deviations occur on installation positions of the electrodes and/or gaps between the electrodes and rotation drum in comparison with their design data, it is possible to perform printing with good linearity by automatically absorbing the deviations. In the case of color printing where different electrodes are provided and aligned at different positions with respect to multiple colors respectively, it is unnecessary to perform mechanical adjustment so that print positions are automatically corrected to improve reproducibility of color images on papers.

Figure 5:
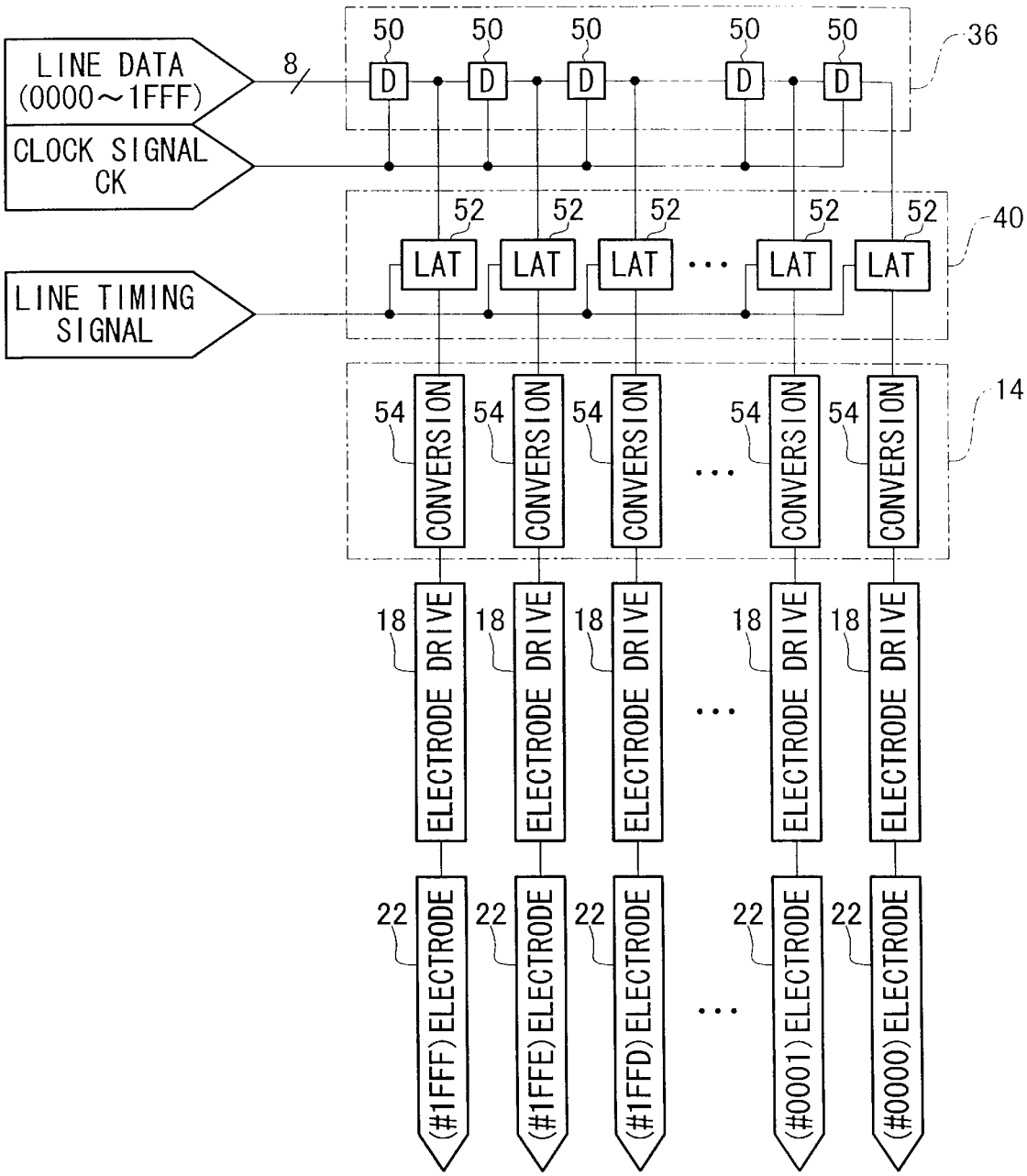
FIG. 5 is a block diagram showing an example of circuitry that ranges from an output timing control section to electrodes in the electrode control unit shown in FIG. 3.

FIG. 5 shows an example of circuitry that lies between the output timing control section 10 and the electrodes 22. In FIG. 5, the serial-parallel conversion block 36 contains one-cycle delays (each represented by a symbol "D") 50, a number of which is identical to the number of the electrodes 22 which are connected together in a cascade-connection manner. The gradation data hold block 40 contains data hold circuits, i.e., latch circuits (each represented by a symbol "LAT") 52 which hold delayed outputs of the one-cycle delays 50 respectively. That is, the latch circuits 52 latch gradation values which are delayed by the one-cycle delays 50 respectively. The pulse generation section 14 contains conversion circuits 54, which convert the delayed gradation values of the latches 52 to pulse signals respectively.

One line of line data consisting of the prescribed number (i.e., 8192) of gradation data are input to the one-cycle delays 50, which are connected together in a cascade-connection manner in the serial-parallel conversion block 36. Then, delayed outputs of the one-cycle delays 50 are respectively forwarded to the latch circuits 52 of the gradation data hold block 40. Herein, each of the latch circuits 52 holds gradation data of eight bits in connection with one electrode. Each of the one-cycle delays 50 operates based on the clock pulses of the clock signal (see FIG. 4B), while each of the latch circuits 52 operates based on line timing pulses of the line timing signal (see FIG. 4A). Outputs of the latch circuits 52 are forwarded to the conversion circuits 54, which produce pulse signals in proportion to gradation values input thereto. As outputs of the conversion circuits 54, it is possible to employ a variety of pulse signals based on electric voltages, electric currents, electric charges, etc. Herein, it is possible to use pulse signals consisting of pulses whose pulse widths depend on constant voltage or current. Or, it is possible to use pulse signals consisting of pulses, a number of which depends on constant voltage or current.

Figures 6A, 6B, 6C, 6D, 6E, 6F, 6G:
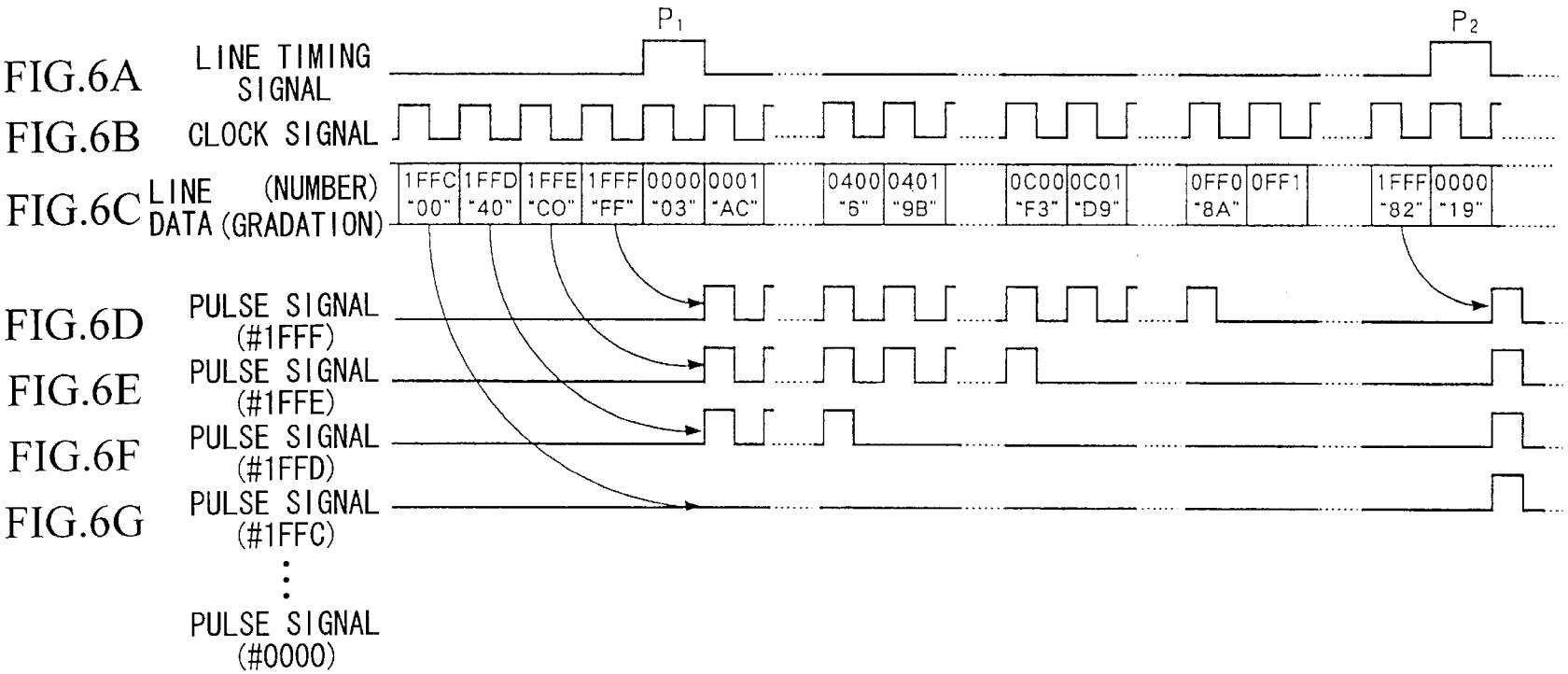
FIG. 6A shows a line timing signal consisting of line timing pulses.
FIG. 6B shows a clock signal consisting of clock pulses.
FIG. 6C shows line data consisting of gradation data.
FIG. 6D shows a pulse signal consisting of pulses being generated for an electrode #1FFF.
FIG. 6E shows a pulse signal consisting of pulses being generated for an electrode #1FFE.
FIG. 6F shows a pulse signal consisting of pulses being generated for an electrode #1FFD.
FIG. 6G shows a pulse signal consisting of pulses being generated for an electrode #1FFC.
Figures 7A, 7B, 7C, 7D, 7E, 7F, 7G:
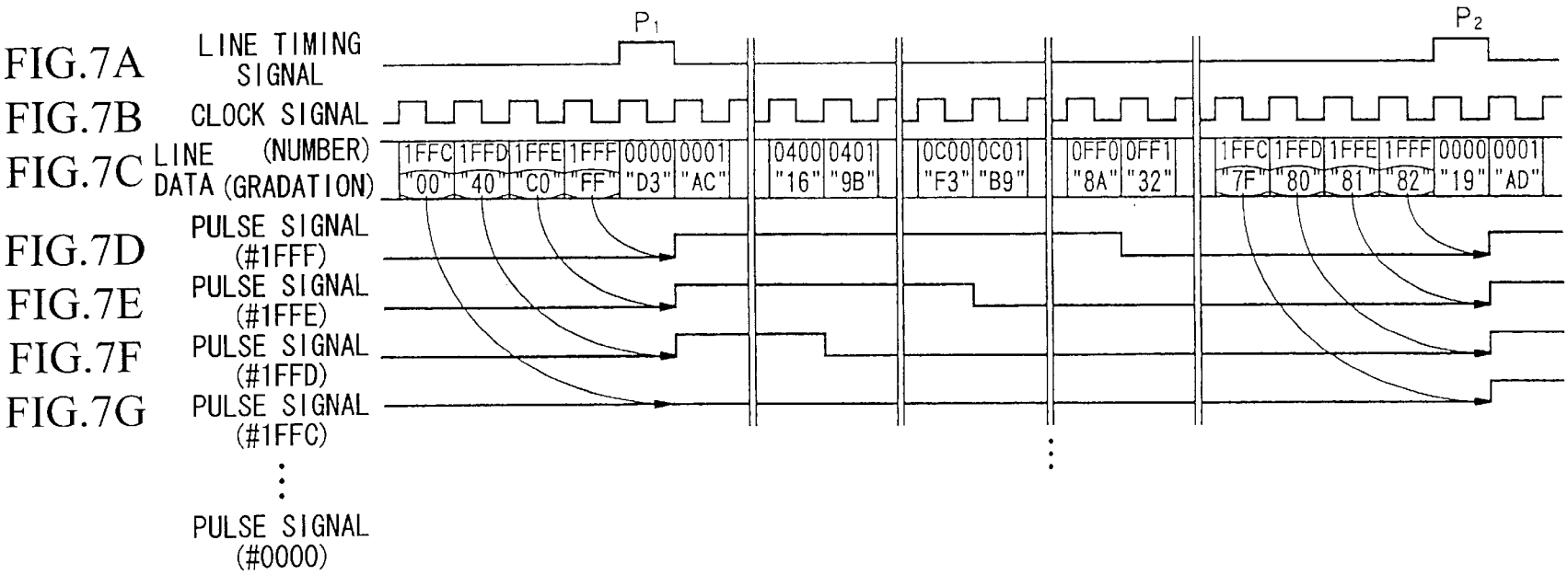
FIG. 7A shows a line timing signal consisting of line timing pulses.
FIG. 7B shows a clock signal consisting of clock pulses.
FIG. 7C shows line data consisting of gradation data.
FIG. 7D shows a pulse signal including a single pulse being generated for the electrode #1FFF.
FIG. 7E shows a pulse signal including a single pulse being generated for the electrode #1FFE.
FIG. 7F shows a pulse signal including a single pulse being generated for the electrode #1FFD.
FIG. 7G shows a pulse signal including a single pulse being generated for the electrode #1FFC.
Figures 8A, 8B, 8C, 8D, 8E, 8F, 8G:
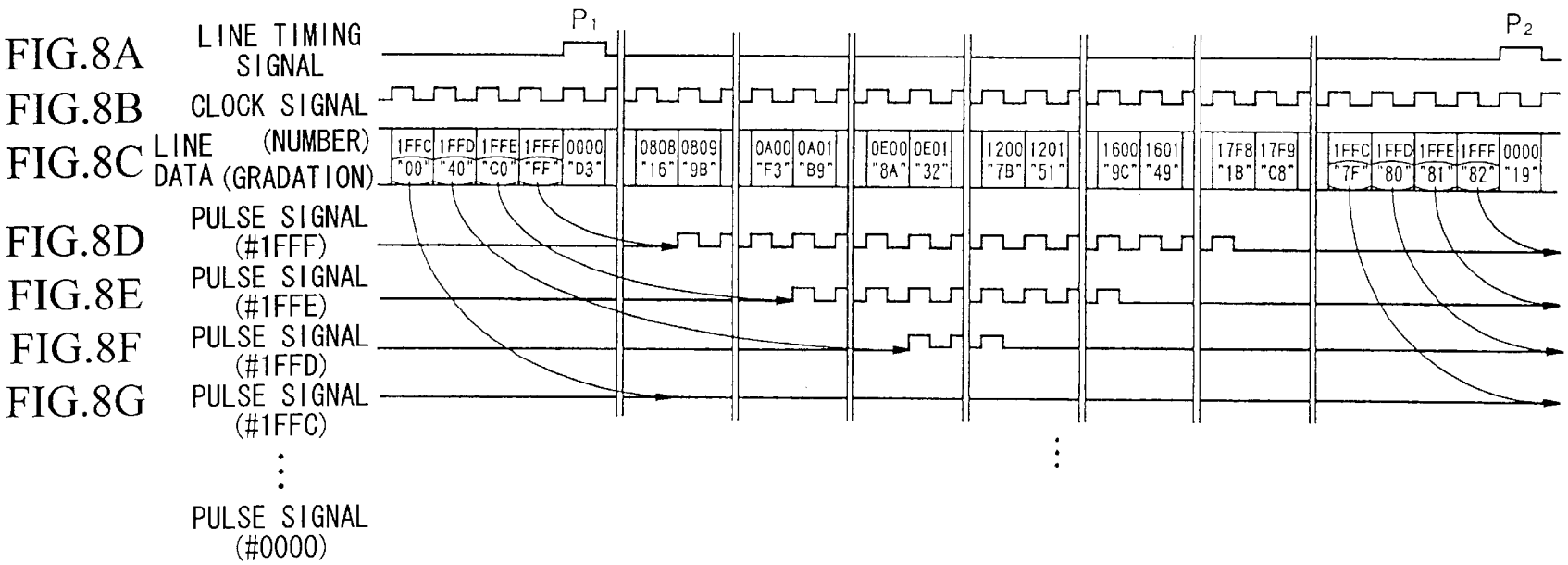
FIG. 8A shows a line timing signal consisting of line timing pulses.
FIG. 8B shows a clock signal consisting of clock pulses.
FIG. 8C shows line data consisting of gradation data.
FIG. 8D shows a pulse signal consisting of pulses being generated for the electrode #1FFF.
FIG. 8E shows a pulse signal consisting of pulses being generated for the electrode #1FFE.
FIG. 8F shows a pulse signal consisting of pulses being generated for the electrode #1FFD.
FIG. 8G shows a pulse signal being generated for the electrode #1FFC.
Figures 9A, 9B, 9C, 9D, 9E, 9F, 9G:
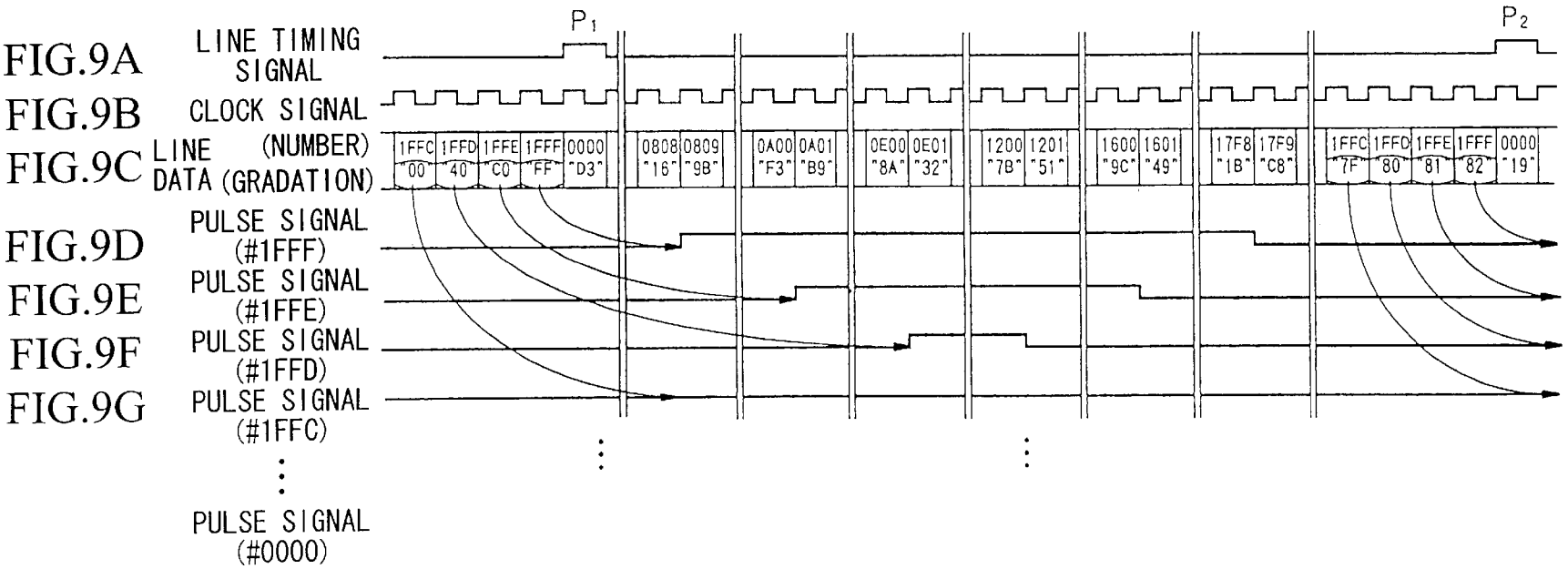
FIG. 9A shows a line timing signal consisting of line timing pulses.
FIG. 9B shows a clock signal consisting of clock pulses.
FIG. 9C shows line data consisting of gradation data.
FIG. 9D shows a pulse signal containing a single pulse being generated for the electrode #1FFF.
FIG. 9E shows a pulse signal containing a single pulse being generated for the electrode #1FFE.
FIG. 9F shows a pulse signal containing a single pulse being generated for the electrode #1FFD.
FIG. 9G shows a pulse signal being generated for the electrode #1FFC.
Figures 10A, 10B, 10C, 10D, 10E, 10F, 10G:
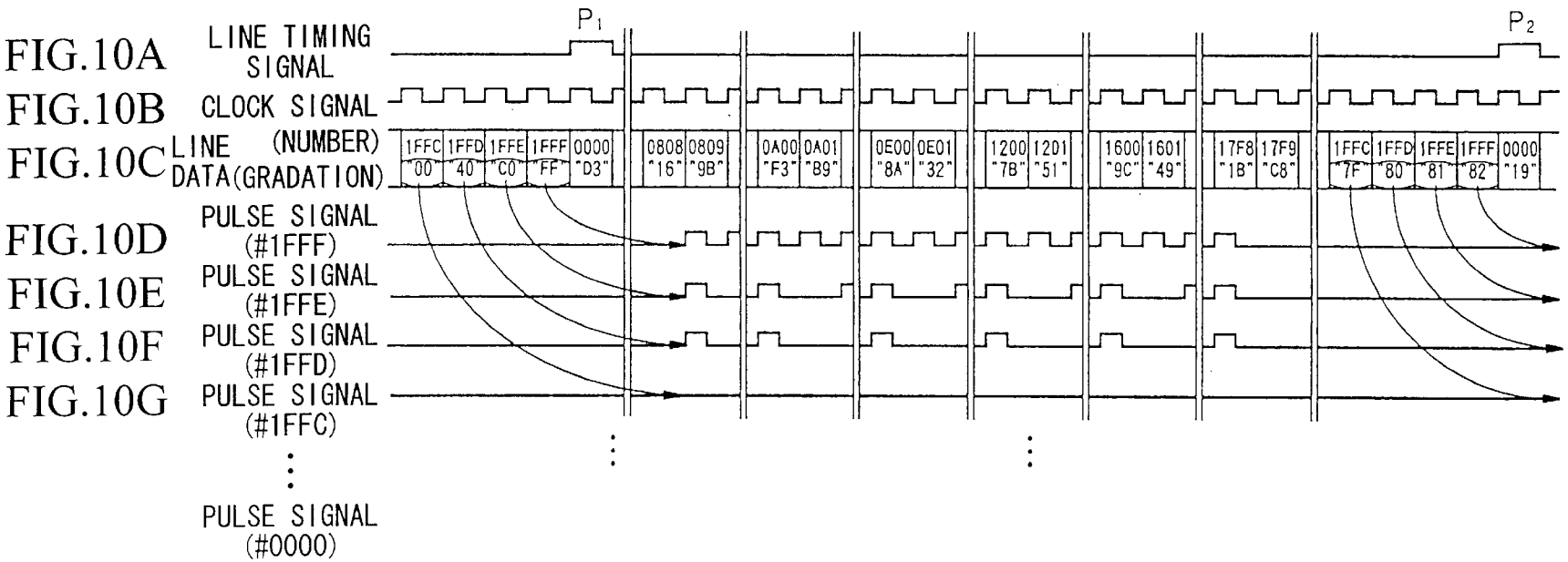
FIG. 10A shows a line timing signal consisting of line timing pulses.
FIG. 10B shows a clock signal consisting of clock pulses.
FIG. 10C shows line data consisting of gradation data.
FIG. 10D shows a pulse signal consisting of pulses being generated for the electrode #1FFF.
FIG. 10E shows a pulse signal consisting of pulses being generated for the electrode #1FFE.
FIG. 10F shows a pulse signal consisting of pulses being generated for the electrode #1FFD.
FIG. 10G shows a pulse signal being generated for the electrode #1FFC.

FIGS. 6A to 6G show an example of relationships between the line data and pulse signals which are output in a parallel manner. Precisely, time charts of FIGS. 6A to 6G are provided in connection with the configuration of the circuitry shown in FIG. 5. Before generation of a line timing pulse $P_1$ (see FIG. 6A), line data consisting of multiple gradation data (see FIG. 6C) are serially supplied to the output timing control section 10, wherein the gradation data are respectively delayed and retained in the gradation data hold block 40. When the line timing pulse $P_1$ is supplied to the gradation data hold block 40, the pulse generation section 14 generates pulse signals corresponding to the gradation data respectively. After occurrence of the line timing pulse $P_1$, the pulse signals are respectively output to electrode drive circuits of the electrode drive section 18 (see FIGS. 6D to 6G). In FIG. 6C, each of blocks being drawn to adjoin together corresponds to each of the gradation data for the electrodes, wherein four hexadecimal numbers written in an upper section of each block indicate a serial number for the electrode, while one or two hexadecimal numbers written in a lower section of each block indicate a gradation value (i.e., gradation data of eight bits) for the electrode. That is, a leftmost block in FIG. 6C shows that a gradation value "00" is assigned to an electrode #1FFC. Similarly, a gradation value "40" is assigned to an electrode #1FFD, a gradation value "C0" is assigned to an electrode #1FFE, and a gradation value "FF" is assigned to an electrode #1FFF. Those gradation values are respectively supplied to the electrode drive circuits 18 of the corresponding electrodes 22 by way of the conversion circuits 54. In the present embodiment, the gradation value is related to a number of pulses of the pulse signal. Hence, each of the electrode drive circuits 18 receives the pulse signal consisting of pulses, which emerge after the line timing pulse $P_1$ and a number of which depends on the corresponding gradation value. As for the electrode #1FFF, for example, its electrode drive circuit receives a pulse signal (see FIG. 6D) consisting of pulses, a number of which depends on the gradation value "FF".

As described above, the gradation values are respectively output toward all the electrodes whose numbers range from #0000 to #1FFF. Thus, pulse signals are correspondingly produced based on the gradation values and are supplied to the electrode drive circuits of the electrodes. After the line timing pulse $P_1$, the output timing control section 10 receives next line data consisting of multiple gradation data serially from the data processing section 6. Those gradation data are delayed and output toward the electrode drive circuits of the electrodes in response to a next line timing pulse $P_2$. Incidentally, FIGS. 6D to 6G show waveforms of only four pulse signals, however, the conversion circuits 54 actually produce pulse signals (ranging from #1FFF to #0000) which are respectively supplied to the electrode drive circuit for respectively driving the electrodes whose numbers range from #1FFF to #0000. Incidentally, each of the conversion circuits 54 converts the gradation value to the pulse signal in a pulse-number increasing manner. Concretely speaking, "0x00" is transferred for the gradation data (1FFC), "0x40" is transferred for the gradation data (1FFD), "0xC0" is transferred for the gradation data (1FFE), and "0xFF" is transferred for the gradation data (1FFF). The conversion circuits 54 receive the gradation data which are transferred thereto to follow the line timing pulse. Herein, each of the conversion circuits 54 produces a pulse signal consisting of pulses, a number of which is ten times larger than a number actually indicated by the gradation value.

FIGS. 6A to 6G show that each of the pulse signals consists of pulses, a number of which depends on the gradation value. FIGS. 7A to 7G show that each of pulse signals consists of a single pulse whose pulse width (or pulse duration) depends on the gradation value. That is, the pulse generation section 14 contains conversion circuits 54, a number of which corresponds to the number of the electrodes 22 and each of which produces a pulse signal consisting of a single pulse whose pulse width depends on the gradation value. Such a pulse signal can be generated by a circuit configuration (containing a counter) in which a number of clock pulses is counted to produce a count value, which is compared with the gradation value to control a trailing edge of the pulse.

In the aforementioned examples of FIGS. 6A–6G and FIGS. 7A–7G, the pulse generation section 14 starts outputting the pulse signals just after the line timing pulses. Hence, pulse patterns for the electrodes 22 in printing are uniformly adjusted in start timing to be just after the line timing signal. However, this indicates that a shortest pulse pattern greatly differs from a longest pulse pattern in end timing. To cope with such a disadvantage, it is possible to propose other examples of pulse signals by way of FIGS. 8A–8G and FIGS. 9A–9G.

Time charts of FIGS. 8A to 8G are provided in connection with the aforementioned time charts of FIGS. 6A to 6G. That is, FIGS. 8D to 8G show pulse signals, each of which is arranged around a center point between two line timing pulses $P_1$, $P_2$ that consecutively emerge on the line timing signal (see FIG. 8A). Herein, each of the pulse signals has a number of pulses, which corresponds to a gradation value and which are arranged in proximity to the center point between the two pulses. Actually, the conversion circuit 54 produces a number of pulses, which corresponds to the gradation value and which range from a first pulse to a last pulse. Herein, a time center point between the first and last pulses is controlled to match with the center point between the line timing pulses $P_1$, $P_2$.

Time charts of FIGS. 9A to 9G are provided in connection with the aforementioned time charts of FIGS. 7A to 7G. That is, FIGS. 9D to 9G show pulse signals each consisting of a single pulse, a pulse width of which corresponds to a gradation value and which is arranged based on a center point between two consecutive line timing pulses on the line timing signal. Actually, the conversion circuit 54 produces a single pulse, a time center point of which matches with the center point between the two line timing pulses $P_1$, $P_2$. According to FIGS. 8A–8G and FIGS. 9A–9G, each of pulse patterns is adjusted in start timing in response to it length, in other words, the pulse patterns are uniformly adjusted in time center point in proximity to the center point between the two consecutive line timing pulses. Thus, it is possible to reduce a difference in start timing and end timing between the shortest pulse pattern and longest pulse pattern.

It is possible to propose a further example of pulse signals each consisting of pulses, which are arranged uniformly with equal spacing therebetween in an interval of time between two consecutive line timing pulses.

Namely, it is possible to propose uniform allocation of pulses of the pulse signal between the two consecutive line timing pulses, which will described with reference to FIGS. 10A to 10G. That is, each pulse signal consists of pulses, a number of which corresponds to a gradation value and which are uniformly arranged with equal spacing therebetween in an interval of time between two line timing pulses $P_1$, $P_2$. As described before, the pulse generation section 14 contains conversion circuits 54, a number of which corresponds to the prescribed number of the electrodes 22. Herein, each of the conversion circuit 54 produces a pulse signal consisting of pulses, a number of which depends on a gradation value and which are uniformly arranged with equal spacing therebetween in an interval of time between the line timing pulses $P_1$, $P_2$. In addition, each of the pulses has a specific pulse width which is determined based on a smallest gradation value within gradation values respectively supplied to the conversion circuits 54. Incidentally, the pulses are not necessarily arranged uniformly with equal spacing therebetween. So, it is possible to produce and arrange the pulses in response to a specific pulse pattern which is specified by the gradation data. Or, it is possible to set uniform allocations of pulses by using a frequency modulation (FM) technique or pulse density modulation technique, for example.

It is possible to configure the conversion circuit 54 by using a rewritable memory such as an EEPROM, which stores pulse patterns in connection with gradation values in advance. Herein, a gradation value is used as an address signal that accesses the memory to read out a corresponding pulse pattern as a pulse signal. In this case, it is possible to actualize the aforementioned examples of the pulse signals (see FIGS. 6D–6G, FIGS. 7D–7G, FIGS. 8D–8G and FIGS. 9D–9G) by changing contents of the pulse patterns stored in the memory.

Next, a gradation correction process will be described.

Figure 11:
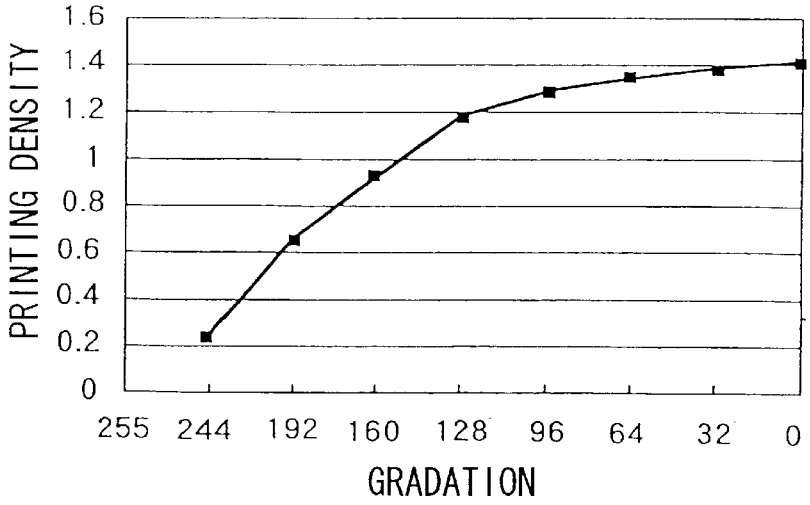
FIG. 11 is a graph showing an example of relationships between gradation values and actual printing densities.

In the circuit configuration shown in FIG. 5, the pulse generation section 14 performs conversion to produce pulse signals in proportion to the gradation values. However, direct proportional relationships are not always established between gradations designated by gradation data and densities in printing being actually performed using ink because of differences in characteristics of papers, types of ink and electrodes. FIG. 11 shows an example of a curve showing a relationship between gradations of gradation data and actual printing densities. FIG. 11 shows a case in which linear relationship is not established between pulse signals, which are directly proportional to gradation values, and actual printing densities with respect to some types of papers and ink. In this case, it is possible to provide an operation circuit (or operation circuits) in the electrode control unit such that desired gradations can be obtained. Herein, the operation circuit corrects data transferred thereto in accordance with a conversion formula (or conversion formulae) given from the external. For example, it is possible to use a conversion formula of quadratic functions, as follows:

$$F(x)=ax^2+bx+c$$

where x is an input gradation value, and an output is given by F(x). In the aforementioned formula, coefficients a, b, c are subjected to fine adjustment to correct the gradation value. Instead of the aforementioned operation circuit, it is possible to provide a table whose content is stored in a memory such as an EEPROM. In this case, the gradation values are corrected with reference to the table.

Corrections of the gradation values can be made by the gradation correction block 30, which is installed in the data processing section 6 shown in FIG. 3. That is, the corrections are made before or after print data are converted to gradation data. Or, it is possible to make the corrections by using the gradation-discriminating pulse tables 44. Herein, the corrections are made when pulse signals are produced from the gradation data.

Figure 12:
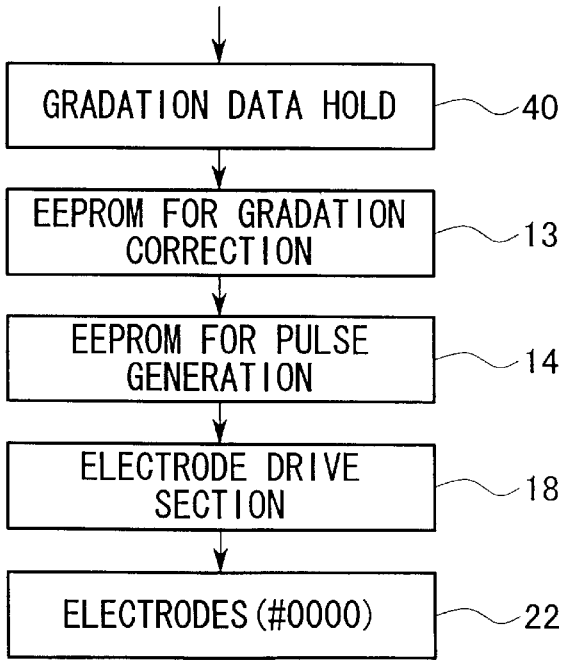
FIG. 12 is a simplified block diagram showing selected parts of circuitry for correcting gradation values using EEPROMs.

FIG. 12 shows selected parts of circuitry which lines between the gradation data hold block 40 and the electrodes 22 in FIG. 3. Herein, the gradation data hold block 40 is followed by an EEPROM 13 for gradation correction which stores a gradation correction table. Pulse signals are produced based on outputs of the EEPROM 13. In the case of FIG. 12, addresses are supplied to the EEPROM 13 to read out corresponding data, which are forwarded to an EEPROM 14 for pulse generation. That is, gradation correction is performed after timing control being made by the gradation data hold block 40. Herein, even if the gradation correction is performed after the timing control, it is possible to complete processes within a certain period of time. Therefore, it is possible to secure linearity in printing with respect to each of the electrodes 22.

Figure 13:
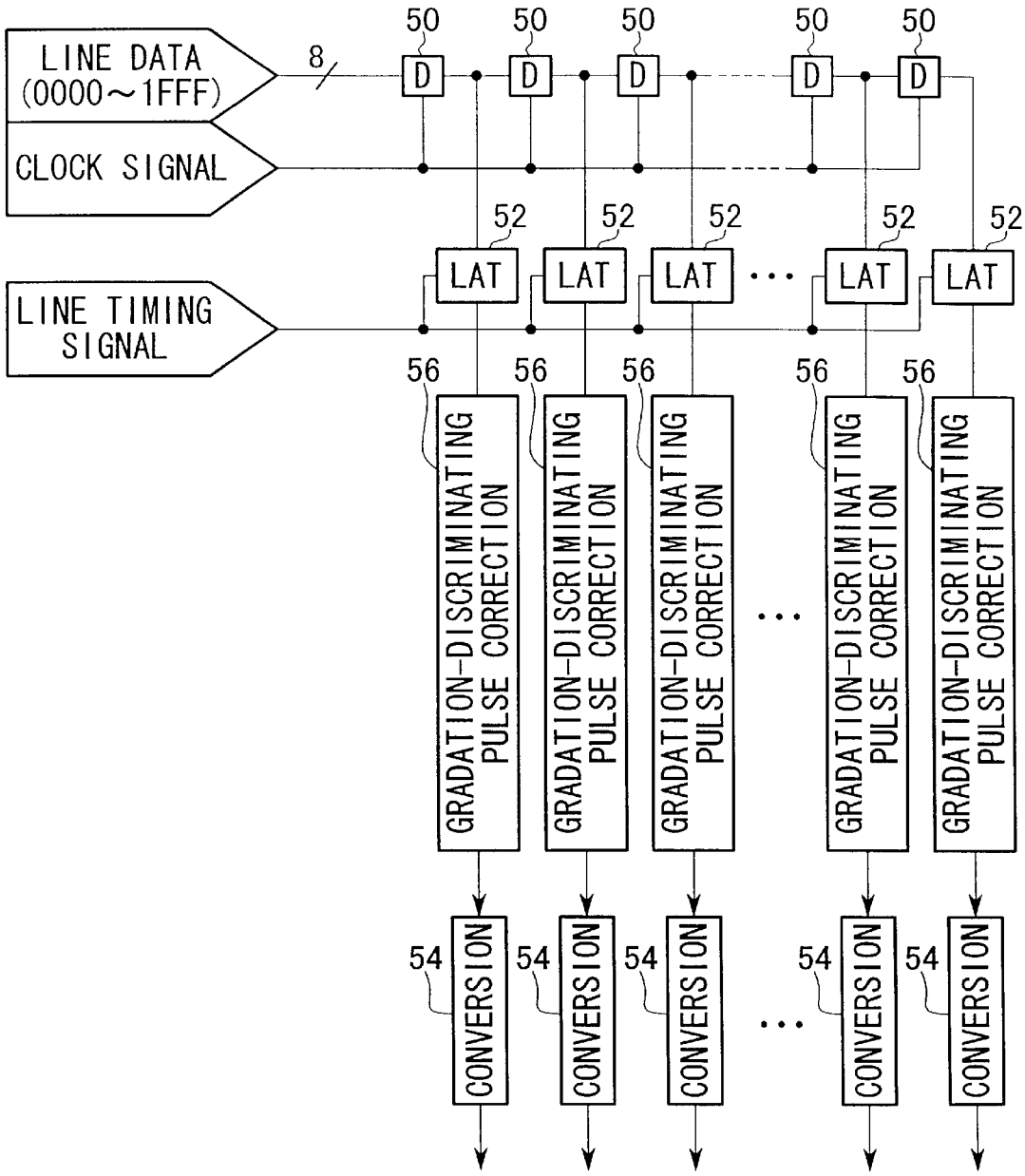
FIG. 13 is a block diagram showing a modified example in which gradation-discriminating pulse correction circuits are inserted between latch circuits and conversion circuits shown in FIG. 5.

FIG. 13 shows selected parts of circuitry that lies between the serial-parallel conversion block 36 and the pulse generation section 14. As compared with FIG. 5, gradation-discriminating pulse correction circuits 56 are inserted between the gradation data hold block 40 and the pulse generation section 14 with respect to the electrodes 22 respectively. The circuitry of FIG. 13 is provided to obtain desired printing densities directly corresponding to designated gradation data by correcting non-linear relationships between gradation values and actual printing densities. In order to do so, the gradation-discriminating pulse correction circuits 56 are provided prior to the conversion circuits 54. Because the gradation-discriminating pulse correction circuits 56 are provided with respect to the electrodes respectively, it is possible to perform corrections on differences between installation positions of the electrodes and differences between characteristics of the electrodes as well.

It is possible to further incorporate complementary functions to the aforementioned corrections. In that case, it is possible to increase conversion precision to be greater than an original input. For example, even when an input x is 8-bit data, it is possible to increase a number of bits contained in conversion output F(x) which is given from the aforementioned formula or readout which is given with reference to the aforementioned table. Because of the corrections described above, it is possible to approach representations of shading in printing (in other words, printing densities) to be more close to ones that human operators (or users) intend to obtain.

The coefficients of the conversion formula or values of the table are stored in a storage device provided inside of the electrode control unit. It is possible to configure the storage device such that stored content can be rewritten from the external. In addition, it is possible to provide two sets of coefficients or two sets of tables, which are adequately combined to perform desired corrections. Herein, one set is used for corrections of manufacturing dispersion in characteristics of printers being shipped, while another set is used for corrections of relationships between papers and types of ink being used in printing. Concretely speaking, the gradation-discriminating pulse correction circuits 56 store data for the corrections of manufacturing dispersion, while the data processing section 6 performs gradation-density corrections based on papers and types of ink being used in printing, wherein the gradation-density corrections are irrelevant to the electrodes. Further, it is possible to provide feedback control in which printing densities of print results are detected to control the gradation-discriminating pulse correction circuits 56 or they are detected and being reflected on stored content of the gradation correction table 32.

To accomplish corrections of print positions, it is preferable to provide the electrode-alignment-direction print position correcting function 38 for correcting print positions in the alignment direction of the electrodes and the paper-feed-direction print position correcting function for correcting print positions in the paper-feed direction. Those functions will be described in further detail below.

Figure 14:
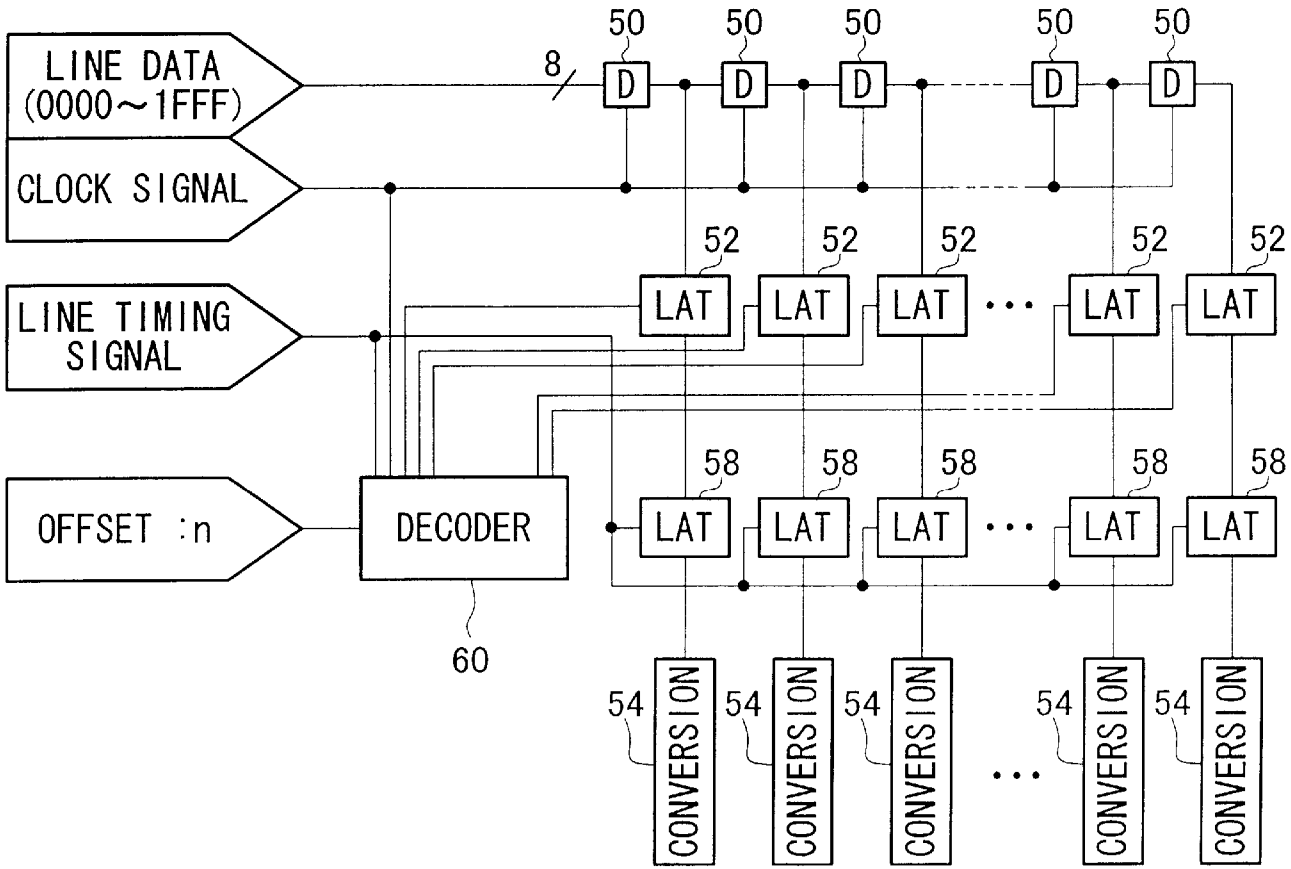
FIG. 14 is a block diagram showing a configuration of circuitry regarding the output timing control section and pulse generation section, which is used to correct print positions in an alignment direction of electrodes.

The electrode-alignment-direction print position correcting function 38 is performed by circuitry shown in FIG. 14. That is, there are provided a great number of electrodes, which is greater than a number of electrodes being normally required for performing printing on prescribed papers. So, print positions are delicately adjusted in an alignment direction of the electrodes within a range of alignment of such a great number of electrodes. In the case of color printing, a same paper is repeatedly subject to printing of different colors. In that case, primary-color printed images may be shifted from each other among different colors unless adjustments are not sufficiently made in print positions in the paper-feed direction. However, the aforementioned circuitry is capable of easily correcting positional deviations of colors.

Normally, zero (or 0) is given as a first offset signal. In addition, there are provided a number of slots, each of which is designated by a slot number "k" (where "k" is an integer arbitrarily selected from among prescribed numbers which range from 0x0 to 0x1FFF in hexadecimal notation). That is, data allocated to the slot number k is held by a data hold circuit which is connected with an electrode whose number is k within the electrodes. In the present embodiment, effective print data range from 0x200 to 2x1DFF, in other words, there are provided an effective range of print data, which are designated by prescribed symbols (i.e., $D_{0x0200}$ to $D_{0X1DFF}$). In connection with those print data, there are provided conversion circuits, which are designated by prescribed symbols (i.e., $T_{0x0200}$ to $T_{0x1DFF}$). So, the effective print data $D_{0x0200}$ to $D_{0x1DFF}$ are respectively sent to electrodes corresponding to the conversion circuits $T_{0x0200}$ to $T_{0x1DFF}$. Thus, ink dots corresponding to the effective print data are respectively printed at prescribed positions corresponding to the electrodes on the paper. Considering that 0x10 is given as a first offset, effective print data range from 0x200 to 0x1DFF, which are respectively supplied to the electrodes whose numbers range from 0x210 to 0x1E0F. Thus, ink dots corresponding to the effective print data are respectively printed at prescribed positions corresponding to the electrodes on the paper. As a result, a range of printing is shifted by 0x10 electrodes in the alignment direction of the electrodes.

In the above, offset control using a single electrode control unit is described with reference to FIG. 14. Of course, it is possible to perform similar offset control using multiple sets of electrode control units. For example, the offset control is effected on an arrangement of electrode control units, all of which have a same configuration and a number of which depends on the prescribed number of electrodes. In that case, the electrode control units are given different first offsets respectively to control all the electrodes. Suppose that there are provided "n" electrode control units, each of which controls "m" electrodes (where "m" and "n" are integers both greater than "1"). Normally, it is presumed that a first electrode control unit is given its first offset of 0 (zero), a second electrode control unit is given its first offset of m, and an n-th electrode control unit is given its first offset of (n−1)m. That is, the first electrode control unit controls its own electrodes in response to print data whose numbers range from 0 to (m−1), the second electrode control unit controls its own electrodes in response to print data whose numbers range from m to (2m−1), and the n-th electrode control unit controls its own electrodes in response to print data whose numbers range from (n−1)m to (nm−1). Thus, the electrode control units respectively control their electrodes to print ink dots at prescribed positions corresponding to the print data on the paper. Shifting print positions in the alignment direction of the electrodes is realized by increasing or decreasing the first offsets respectively supplied to the electrode control units by numbers each designating a number of electrodes being shifted.

By installing the paper-feed-direction print position correcting function 42, it is possible to correct print positions in the paper-feed direction, as follows:

Second offset signals are determined with respect to the electrodes respectively. In addition, the gradation data hold block 40 holds one line of gradation values in the latch circuits 52 therein. Those gradation values are respectively shifted in time from the line timing signal on the basis of the second offset signals, then, they are output in parallel. In the circuitry of FIG. 5, the gradation data hold block 40 contains the latch circuits 52, each of which independently operates to hold each of the gradation values. Therefore, it is possible to easily correct print positions in the paper-feed direction by controlling output timings of the gradation values forward or backward on time line.

It is ideal that the electrodes are arranged along a straight line. Because of some reasons in manufacture, however, the electrodes are arranged in a zigzag manner, which is taught by Japanese Patent Application No. Hei 10-134724 (i.e., Japanese Unexamined Patent Publication No. Hei 11-320946), for example. Even if the electrodes are arranged in such a zigzag manner, print data may be transmitted to the printer on the basis of presumption that the electrodes are arranged along the straight line. In this case, it is necessary to perform positional corrections on the electrodes being driven. Because the electrodes are arranged in the zigzag manner, if all the electrodes are driven by the same timing, a printing image of a straight line must be formed in a zigzag manner. Such a drawback can be eliminated by adequately delaying timings to drive the electrodes so that the straight line is precisely printed.

Figure 15:
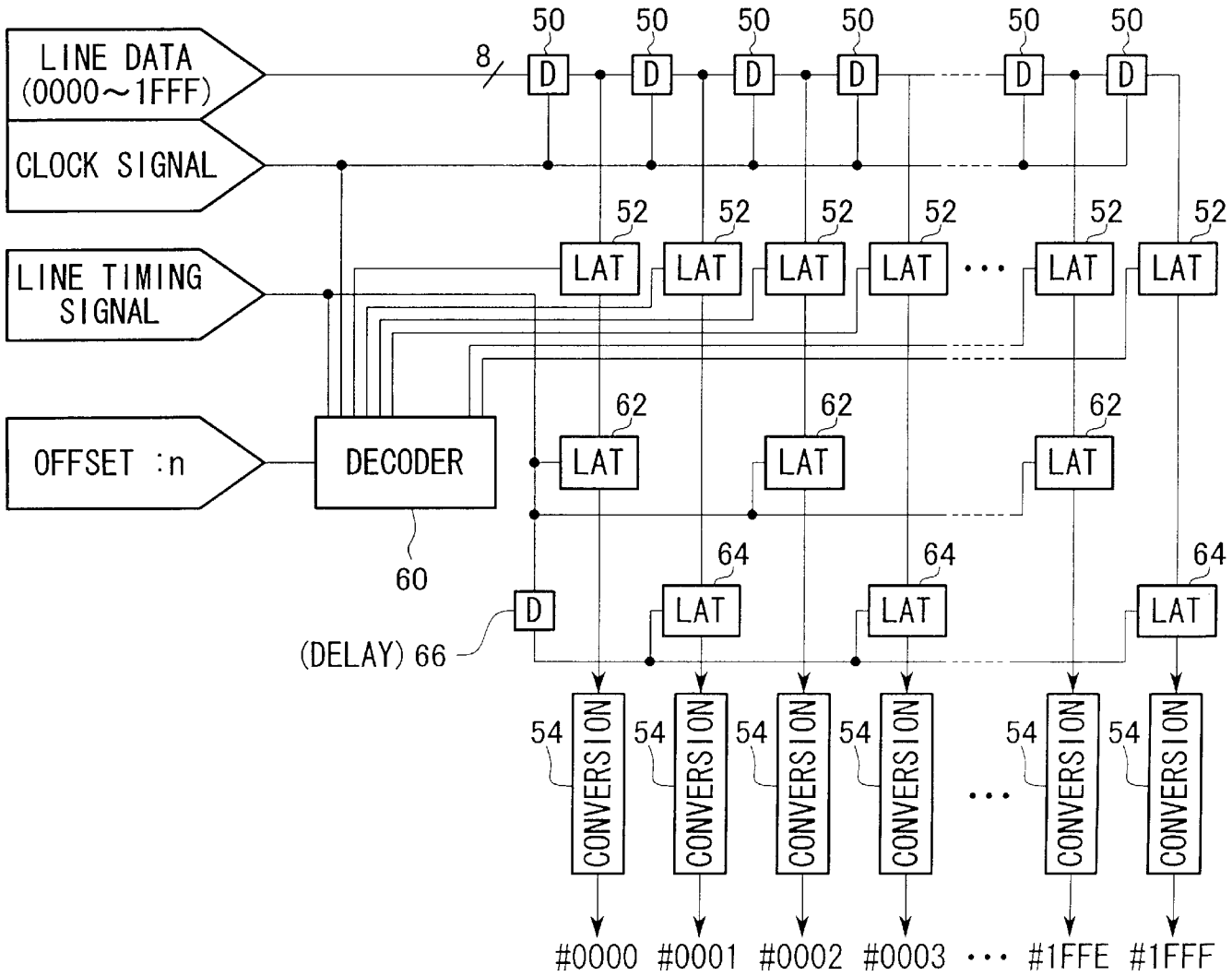
FIG. 15 is a block diagram showing a configuration of circuitry regarding the output timing control section and pulse generation section, which is used to correct print positions in a paper-feed direction.

FIG. 15 shows an example of a configuration of circuitry which is used to correct print positions in the paper-feed direction with respect to electrodes, which are not arranged along a straight line or which are arranged in a zigzag manner. A reference numeral 66 designates a delay circuit ("D" in FIG. 15). A delay value of the delay circuit 66 is determined in response to an interval of distance being measured in the paper-feed direction between two lines of the electrodes, which are arranged in the zigzag manner, and rotation speed (or paper-feed speed) of the rotation drum. In FIG. 15, all the electrodes are divided into two groups, i.e., a first line of electrodes #0000, #0002, . . . , #1FFE and a second line of electrodes #0001, #0003, . . . , #1FFF, which are shifted in alignment position in the paper-feed direction. The delay circuit 66 is connected with only the second line of the electrodes. Thus, gradation values are forwarded to the first line (or first group) of the electrodes #0000, #0002, . . . , #1FFE. In addition, gradation values are delayed by the delay circuit 66 and are then forwarded to the second line (or second group) of the electrodes #0001, #0003, . . . , #1FFF.

The aforementioned examples of the present embodiment are designed such that 8-bit gradation data is transferred using an 8-bit signal line one by one. It is possible to use a 32-bit signal line for transfer of the gradation data. In that case, four sets of the 8-bit gradation data are multiplexed and transferred across the 32-bit signal line.

Figure 16:
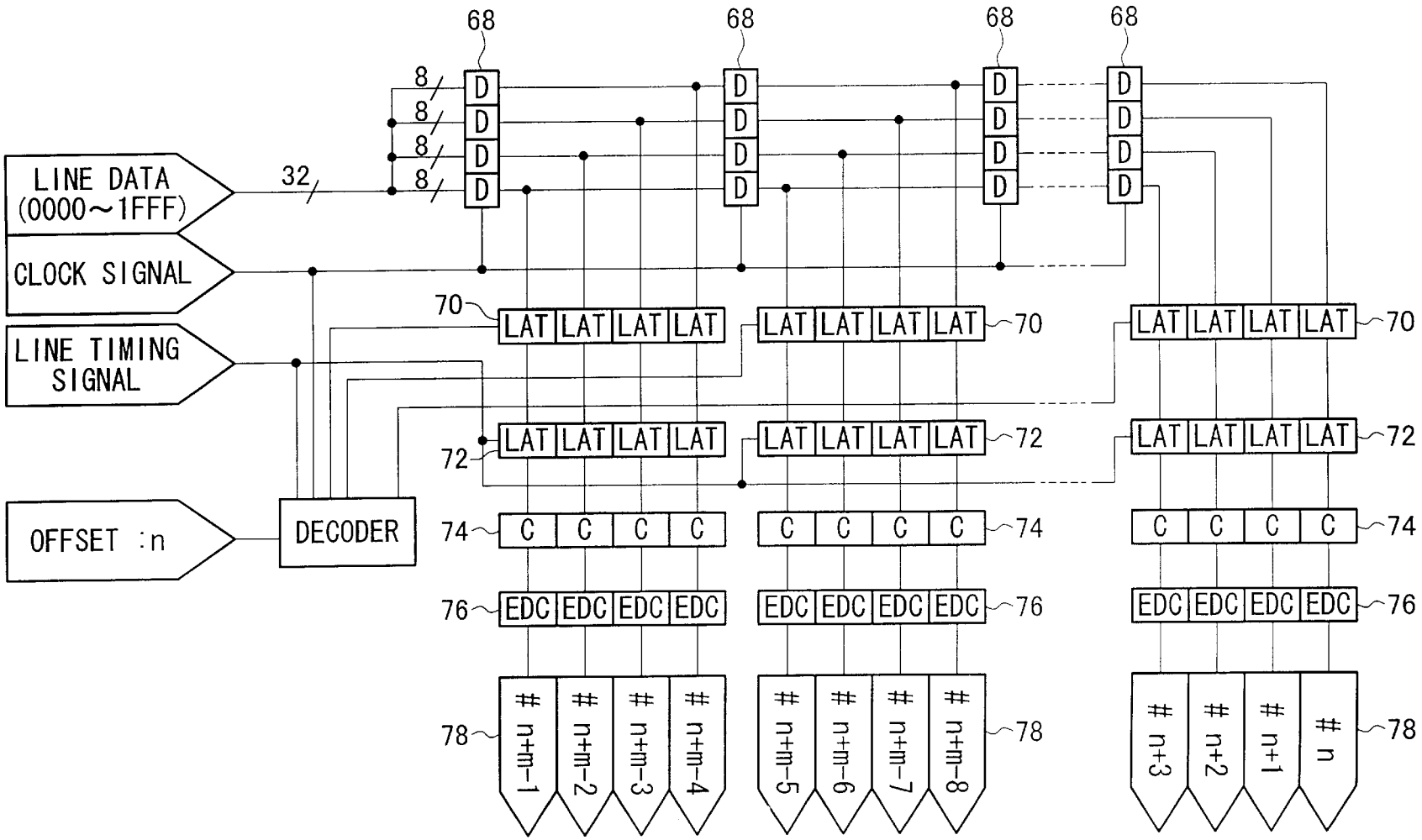
FIG. 16 is a block diagram showing a configuration of circuitry regarding selected parts of the electrode control unit which is designed to enable transfer of four gradation data at once.

FIG. 16 shows an example of circuitry to facilitate parallel output of four sets of the gradation data. That is, the circuitry of FIG. 16 is expanded in configuration to enable 32-bit data processing, which is four times greater than the circuitry of FIG. 5. In FIG. 16, line data are transferred across a single 8-bit signal line in accordance with a time division multiplexing technique. It is possible to reduce a transfer rate of the gradation data multiplexing four signal lines, each of which copes with 32-bit data transfer for collecting four sets of 8-bit data. In the circuitry of FIG. 5, a single electrode control unit is used to control all the electrodes. Of course, it is possible to provide multiple electrode control units, each of which controls a division of electrodes.

Upon receipt of line data, the circuitry of FIG. 16 controls m electrodes whose numbers range from #n to #n+m−1. Upon receipt of line data which are transferred across a 32-bit signal line, four gradation data are respectively input to four one-cycle delays 68, outputs of which are then forwarded to latch circuits 70 respectively. Herein, the one-cycle delays 68 operate based on clock pulses of the clock signal, while the latch circuits 70 operate based on offset data and line timing signal. Concretely speaking, the latch circuits are controlled such that at a timing of a line timing pulse, "n" gradation data (where "n" corresponds to an offset) are transferred without being latched, then, "m" gradation data are respectively latched. Incidentally, gradation data that are transferred before or after the "m" gradation data are latched by latch circuits corresponding to other electrodes (not shown). Conversion circuits 74 respectively convert gradation data latched by the latch circuits to signals which are proportional to gradation values. Based on those signals, electrode control circuits 76 output drive signals for driving electrodes.

Figure 17:
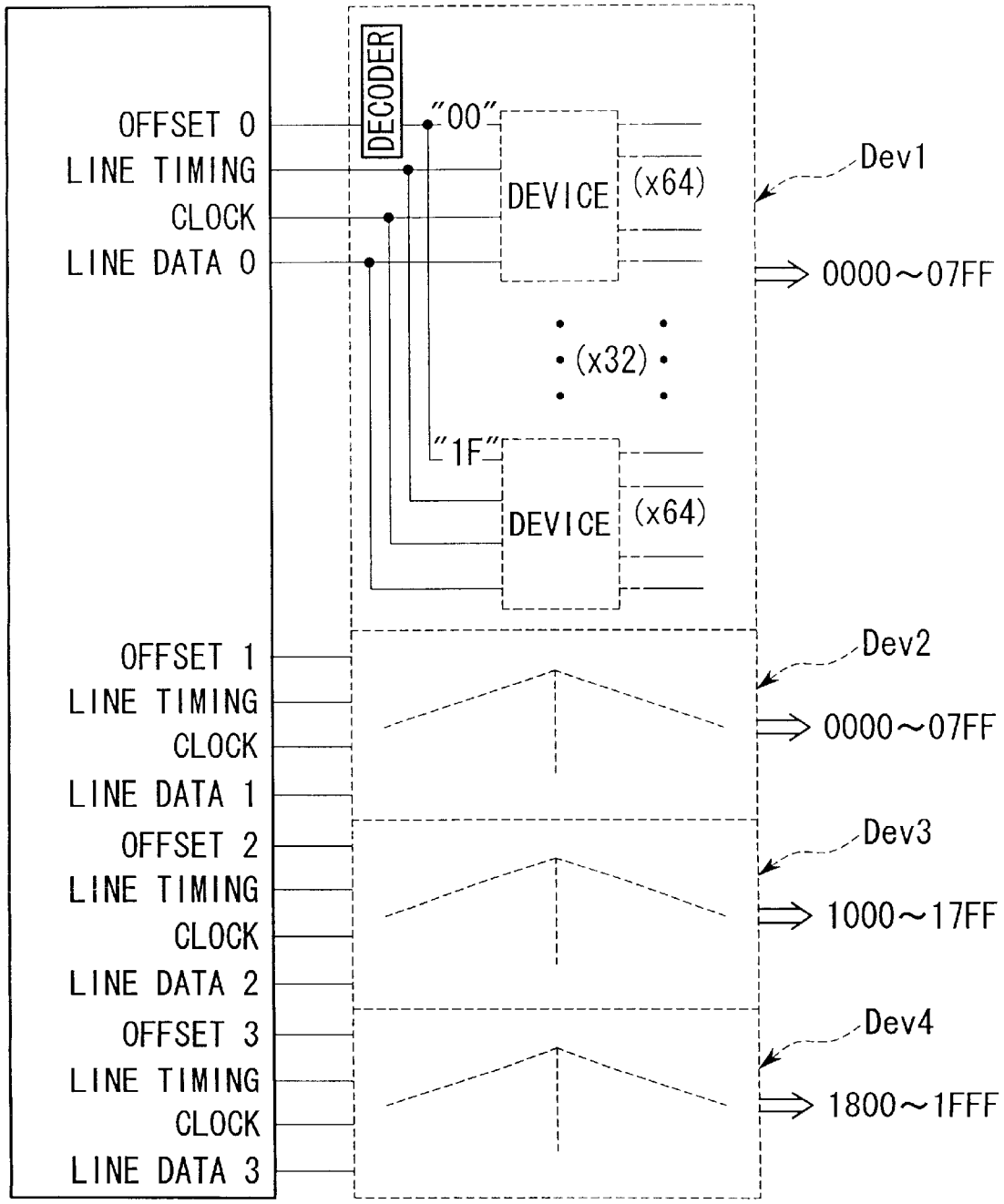
FIG. 17 is a block diagram showing circuitry that installs four sets of the circuitry of FIG. 14 as four devices to enable 32-bit data processing and multiplexing.
Figures 18A, 18B, 18C, 18D, 18E, 18F:
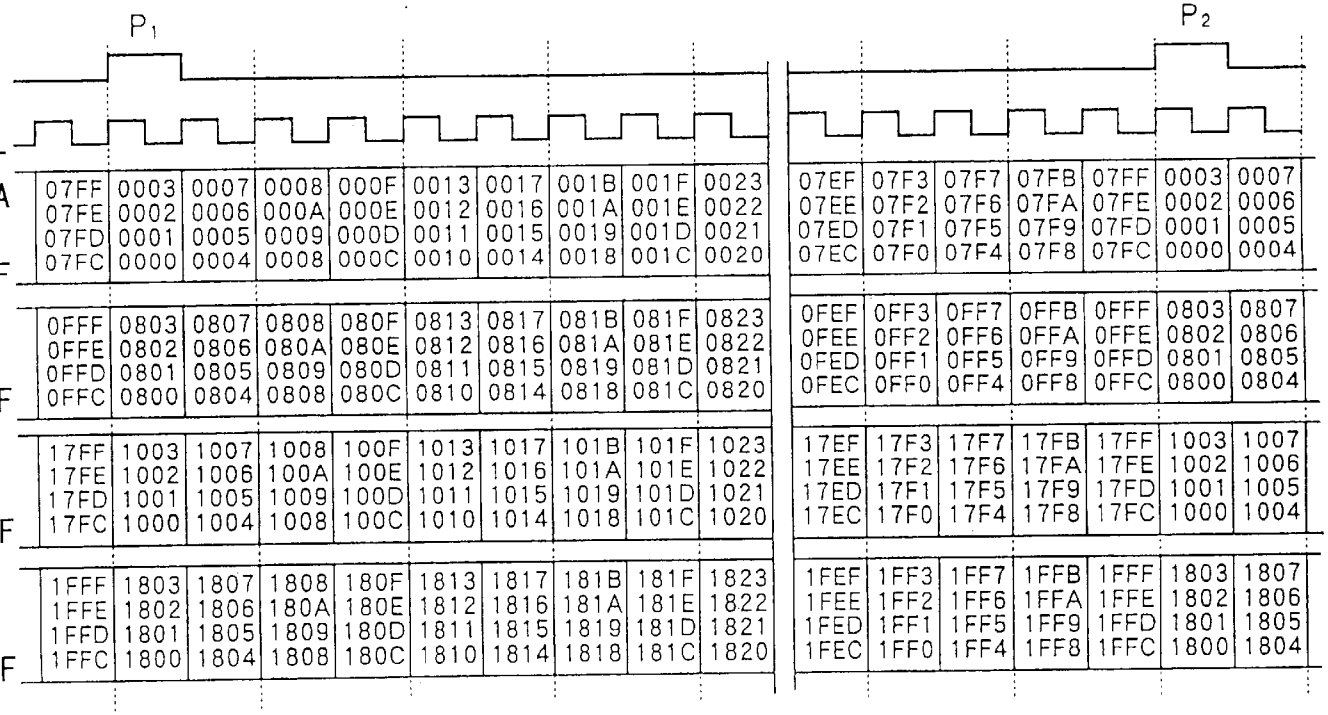
FIG. 18A shows a line timing signal consisting of line timing pulses.
FIG. 18B shows a clock signal consisting of clock pulses.
FIG. 18C shows a first series of 32-bit line data handled by a first device Dev1 in connection with a first division of electrodes, namely, data of 0000 to 07FF.
FIG. 18D shows a second series of 32-bit line data handled by a second device Dev2 in connection with a second division of electrodes, namely, data of 0800 to 0FFF.
FIG. 18E shows a third series of 32-bit line data handled by a third device Dev3 in connection with a third division of electrodes, namely, data of 1000 to 17FF.
FIG. 18F shows a fourth series of 32-bit line data handled by a fourth device Dev4 in connection with a fourth division of electrodes, namely, data of 1800 to 1FFF.

FIG. 17 shows a configuration of circuitry that provides four sets of the circuitry shown in FIG. 14 in parallel. That is, the circuitry of FIG. 17 contains four devices Dev1, Dev2, Dev3 and Dev4 which control four divisions of electrodes, namely, data of 0000 to 07FF, data of 0800 to 0FFF, data of 1000 to 17FF and data of 1800 to 1FFF in hexadecimal notation. Each of the devices Dev1 to Dev4 input a line timing signal and a clock signal (CK) as well as each of four line data in parallel. As the line data, the devices Dev1, Dev2, Dev3 and Dev4 input line data 0, line data 1, line data 2 and line data 3 respectively. Thus, the devices respectively drive electrodes thereof on the basis of the input signals and line data.

FIGS. 18A to 18F show an example of print data used for the circuitry of FIG. 17. There are provided plenty of gradation data (each configured by eight bits) for 8192 electrodes in total. Herein, each slot of line data correspond to 32-bit data, which consist of four consecutive 8-bit gradation data. All the line data are divided into four series of line data, which are respectively handled by four devices Dev1, Dev2, Dev3 and Dev4 in connection with four divisions of electrodes, namely, data of 0000 to 07FF, data of 0800 to 0FFF, data of 0x1000 to 0x17FF and data of 0x1800 to 0x1FFF in hexadecimal notation (see FIGS. 18C to 18F). A line timing pulse (see FIG. 18A) designates a timing for transfer of four types of data, namely, 0x0000, 0x0800, 0x1000 and 0x1800. Numbers written in slots of the line data shown in FIGS. 18C to 18F are numbers of data being transferred. As compared with the foregoing 8-bit data processing, it is possible to reduce a transfer rate of the gradation data by a factor of 1/16.

In the above, four gradation data are multiplexed and transferred. Of course, it is possible to perform multiplexing and transfer on a more number ("n") of the gradation data. In that case, the data processing section 6 outputs "n" gradation data representing gradation values in parallel. Then, the serial-parallel conversion block repeats operations to hold the "n" gradation data in "n" hold circuits for the corresponding electrodes until one line of gradation data are completely held. Thereafter, the output timing control section controls the hold circuits to output one line of the gradation data to the pulse generation section in parallel.

Next, electrode drive circuits 18 will be described in detail. It is necessary to design the electrode drive circuits having capabilities of processing plenty of signals in parallel and at high speeds. Hence, it is preferable to use semiconductor circuits such as LSI circuits. In addition, it is possible to adequately change the design of the electrode drive circuit in response to a type of the electrode, which is either a current drive type or a voltage drive type. Typical designs for the electrode drive circuit 18 will be described with reference to the following figures.

Figure 19A:
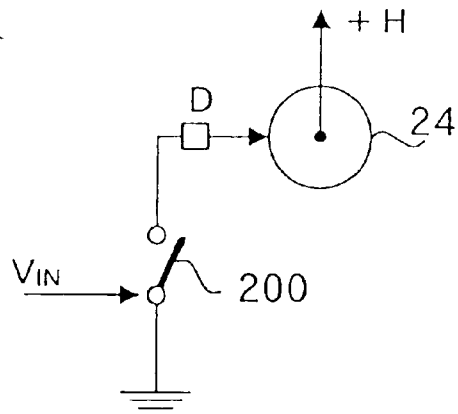
FIG. 19A is a circuit diagram showing a basic configuration of an electrode drive circuit being driven by constant voltage.
Figure 19B:
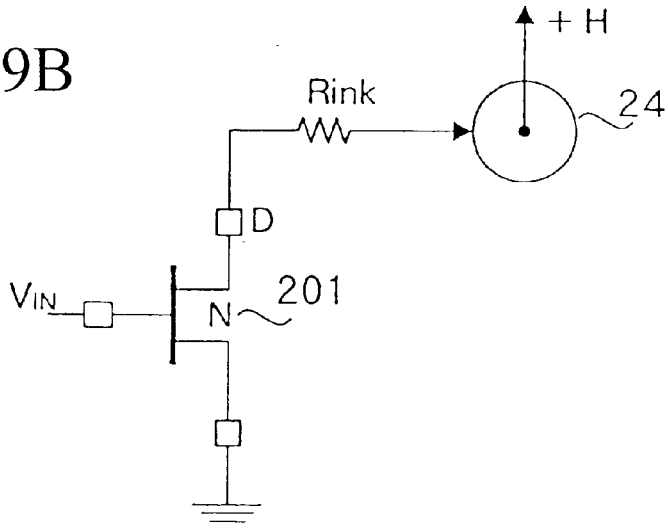
FIG. 19B is a circuit diagram showing an example of the electrode drive circuit in which an n-channel MOS transistor is used for switching.
Figure 19C:
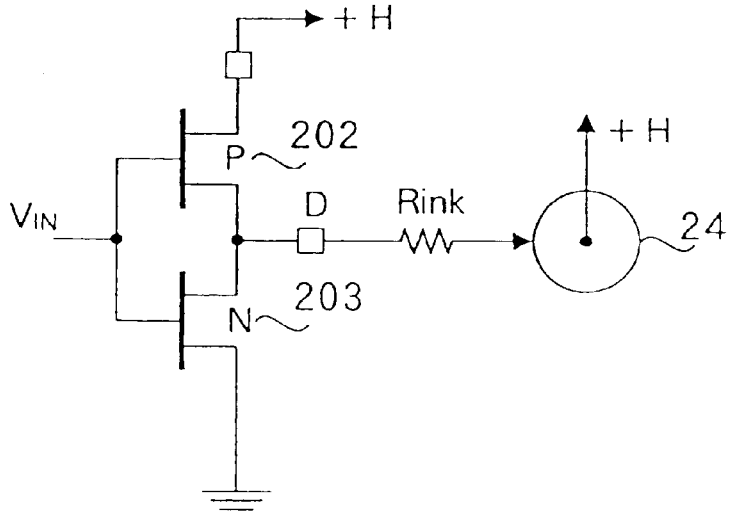
FIG. 19C is a circuit diagram showing another example of the electrode drive circuit in which an inverter configured by two CMOS transistors is used for switching.

FIGS. 19A to 19C show examples of electrode drive circuits being driven by constant voltage. To actualize constant voltage drive, the circuit of FIG. 19A uses a pulse signal to turn on or off a switch 200 so that voltage is applied to the electrode. In FIG. 19A, a pulse signal is applied to $V_{IN}$, So that the switch 200 is turned ON at a trailing edge of a pulse and is turned OFF at a leading edge of the pulse. When the switch 200 is ON, an electric current flows from the rotation drum 24 to an electrode D. Both circuits shown in FIGS. 19B, 19C use the rotation drum 24 and the electrode D. The circuit of FIG. 19B is characterized by that switching is actualized by an n-channel MOS transistor (or MOSFET) 201 (where "MOS" is an abbreviation for "Metal-Oxide Silicon" and "FET" stands for "Field-Effect Transistor"). The circuit of FIG. 19C is characterized by that switching is actualized by an inverter which is configured using two CMOS transistors (or CMOSFETs) 202, 203 (where "CMOS" stands for "Complementary MOS"). Herein, the pulse signal ($V_{IN}$) is inverted in positive/negative polarities by the inverter, an output of which is used to drive the electrode D. The present embodiment is designed such that the rotation drum 24 is subjected to positive potential (+). The circuit of FIG. 19C produces drive voltage in response to an inverse of the pulse signal. In FIGS. 19B and 19C, a reference symbol $R_{ink}$ designates resistance of ink. For convenience' sake, other figures showing circuits omit illustration of the ink resistance $R_{ink}$. The circuit of FIG. 19C is advantageous in that ON/OFF of the electric current can be made with good response. Because the circuit of FIG. 19C uses the CMOS transistors which are suitable for high integration, it is possible to realize parallel drive for plenty of electrodes with low cost.

Figure 20:
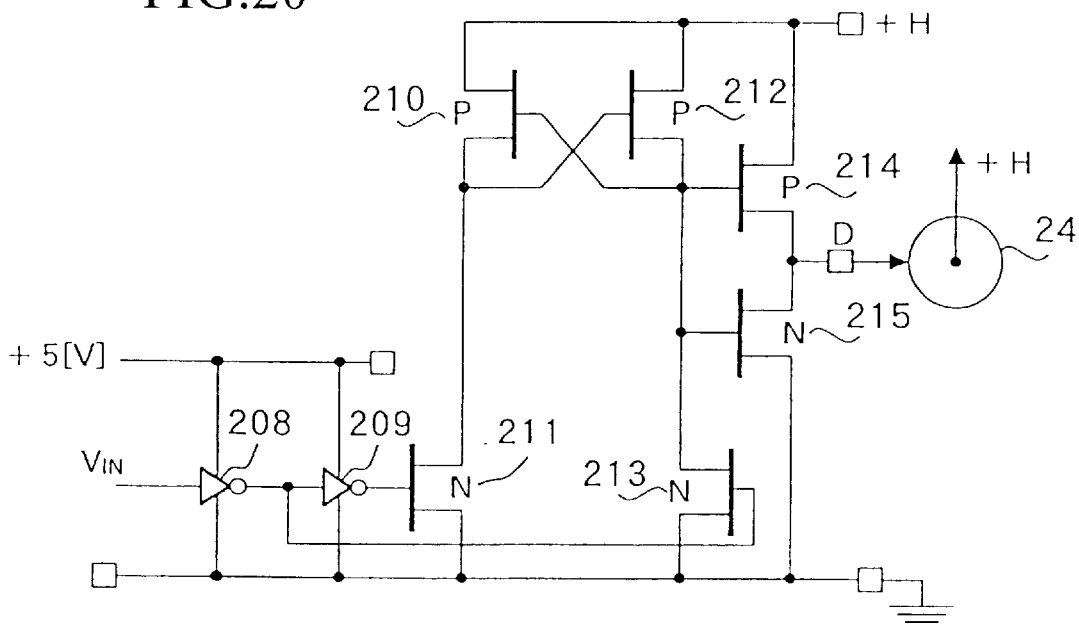
FIG. 20 is a circuit diagram showing an example of an electrode drive circuit using a level shift circuit and being driven by constant voltage.
Figure 21:
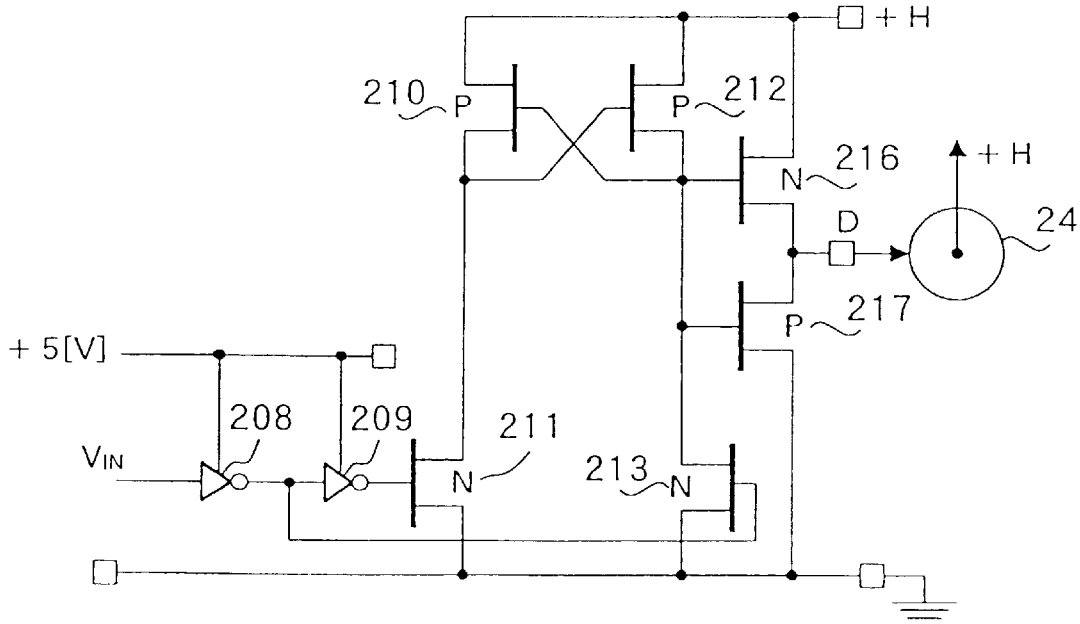
FIG. 21 is a circuit diagram showing an electrode drive circuit of a follower type which is designed by partially modifying the electrode drive circuit of FIG. 20.

FIG. 20 shows an example of an electrode drive circuit using a level shift circuit being driven by constant voltage. In FIG. 20, inverters 208, 209 are connected in series to $V_{IN}$ for inputting a pulse signal. An output of the inverter 209 is supplied to a gate of an n-channel MOS transistor 211, while an output of the inverter 208 is supplied to a gate of an n-channel MOS transistor 213. Herein, the n-channel MOS transistors 211, 213 are alternately turned ON or OFF. Accompanied with operations of the n-channel MOS transistors 211, 213, p-channel MOS transistors 210, 212 are driven respectively. In that case, CMOS transistors 214, 215 are not driven by control voltage but are driven by voltage of +H. FIG. 21 shows an electrode control circuit which is configured by partially modifying the circuit of FIG. 20. That is, the circuit of FIG. 21 uses CMOS transistors 216, 217, which are inverse in channel type as compared with the CMOS transistors 214, 215 used in the circuit of FIG. 20. That is, the CMOS transistor 216 corresponds to an n-channel, while the CMOS transistor 217 corresponds to a p-channel. Thus, the electrode control circuit of FIG. 21 is designed as a follower type.

Figure 22:
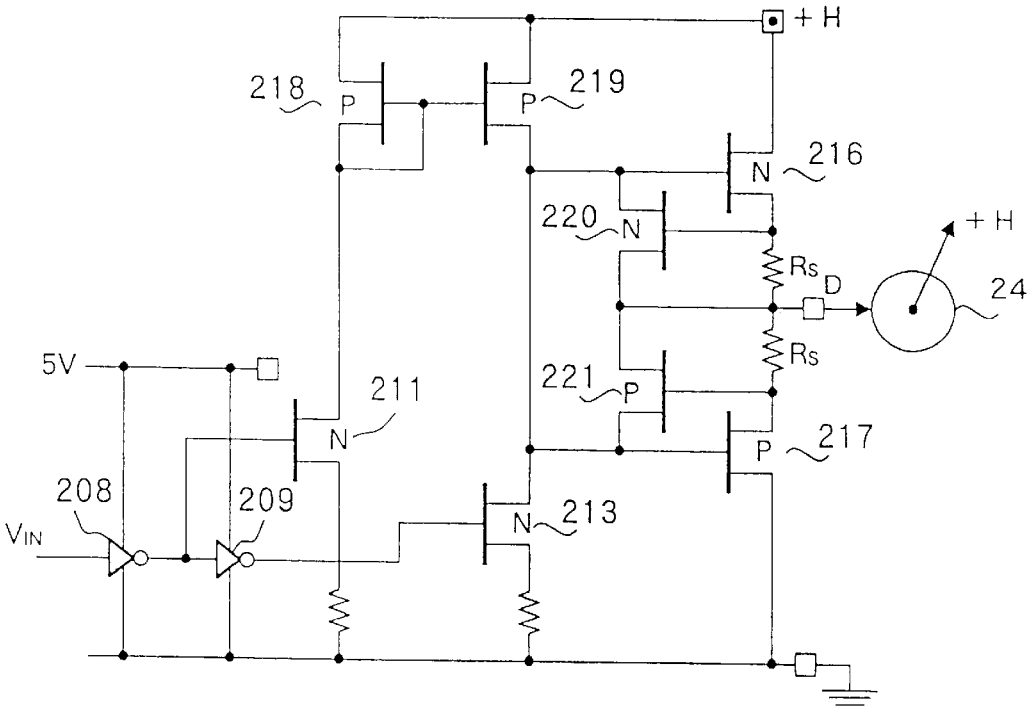
FIG. 22 is a circuit diagram showing an electrode drive circuit using a current limiter and being driven by constant voltage.

FIG. 22 shows an electrode drive circuit using a current limiter being driven by constant voltage. The circuit of FIG. 22 uses n-channel CMOS transistors 216, 220 and p-channel CMOS transistors 217, 221, all of which are connected together. In addition, resistors $R_S$ are inserted between the CMOS transistors 216, 217 with respect to the electrode D. Due to such a configuration of the transistors and resistors, it is possible to limit maximal currents. Thus, it is possible to protect the electrode and transistors from overcurrent. All of the circuits shown in FIGS. 19A–19C and FIGS. 20–22 function as amplifier circuits, which convert voltage of the pulse signal ($V_{IN}$) to drive voltage (+H) of the electrode D. Those circuits can be applied to the electrode drive section 18. In that case, the electrode drive section 18 installs amplifier circuits, a number of which corresponds to the number of electrodes and which supply drive signals of constant voltage to the electrodes on the basis of pulse signals output from the pulse generation section 14.

Figure 23A:
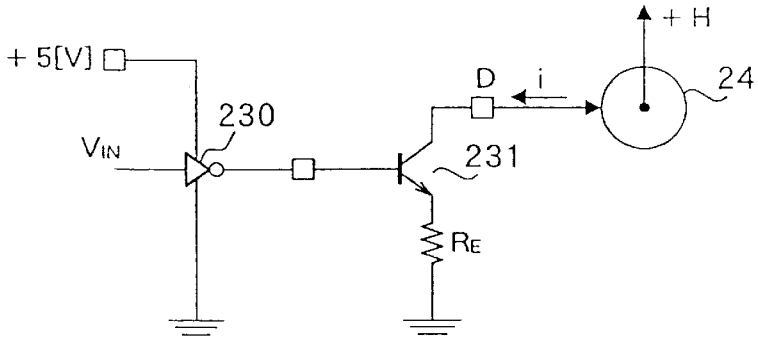
FIG. 23A is a circuit diagram showing an electrode drive circuit using an n-p-n bipolar transistor and being driven by constant current.
Figure 23B:
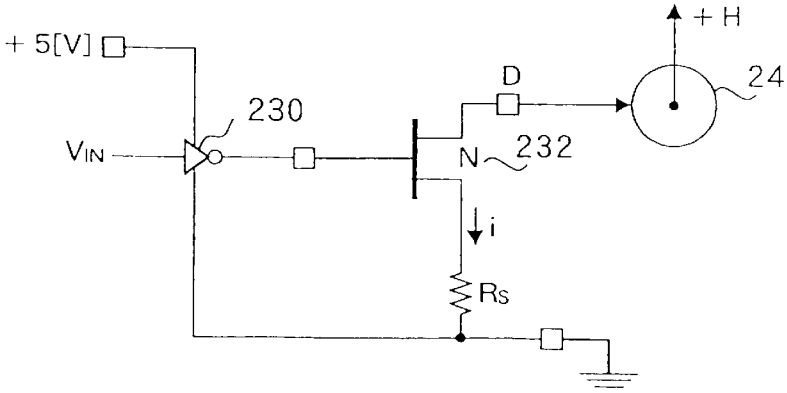
FIG. 23B is a circuit diagram showing an electrode drive circuit using an n-channel transistor and being driven by constant current.

FIGS. 23A, 23B, 24A, 24B, 25A, 25B and 26 show examples of electrode drive circuits being driven by constant current. FIG. 23A shows an electrode drive circuit using a single n-p-n bipolar transistor 231, and FIG. 23B shows an electrode drive circuit using a single n-channel transistor 232. In FIG. 23A, an inverter 230 inverts a pulse signal ($V_{IN}$) and is supplied to a gate of the n-p-n bipolar transistor 231. When the pulse signal is ON (or high level) so that a base current occurs, the transistor 231 is turned ON so that a collector current flows toward the transistor 231 from the rotation drum 24 which is at +H. Thus, the electrode D is driven. The circuit of FIG. 23A uses a resistor $R_E$ which is connected to an emitter of the transistor 231 to stabilize the collector current. The circuit of FIG. 23B is designed by replacing the bipolar transistor 231 with the n-channel transistor 232. Correspondingly, the resistor $R_E$ is replaced by a resistor $R_S$ being connected to a source of the n-channel transistor 232. Operations of the circuit of FIG. 23B are similar to those of the circuit of FIG. 23A, hence, the description thereof will be omitted.

Figure 24A:
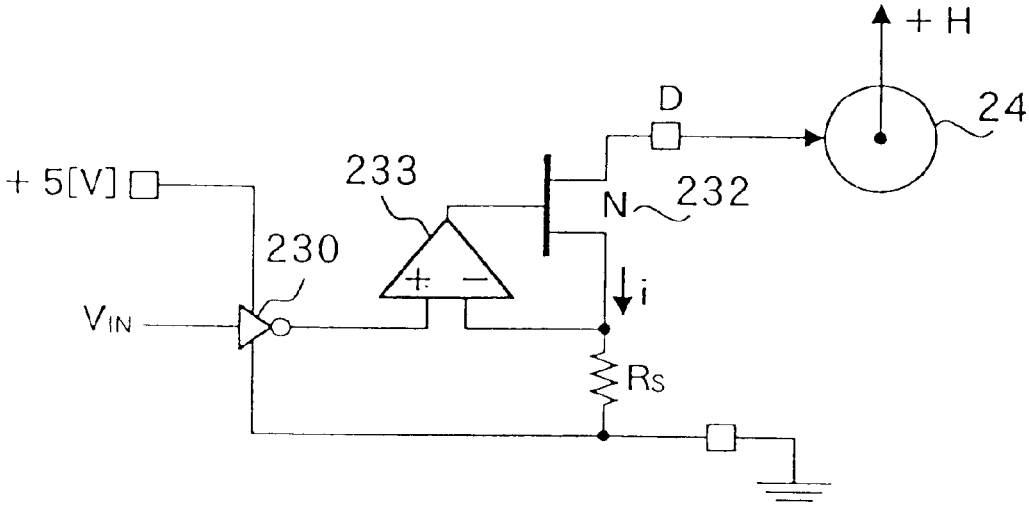
FIG. 24A is a circuit diagram showing an electrode drive circuit using an operation amplifier and an n-channel transistor with constant current drive.
Figure 24B:
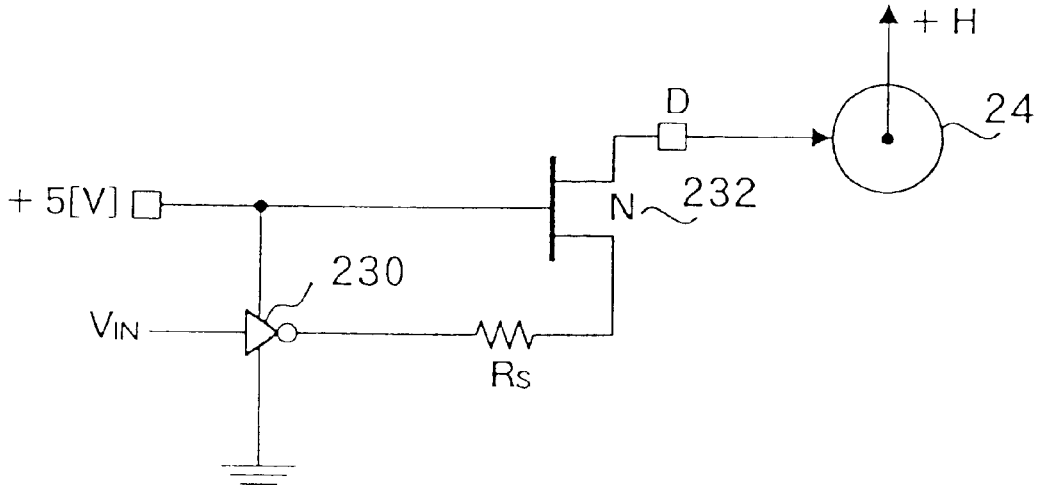
FIG. 24B is a circuit diagram showing an electrode drive circuit which is designed in consideration of high-frequency characteristic.

FIG. 24A shows an electrode drive circuit using an operational amplifier (or comparator) 233 and an n-channel transistor 232. FIG. 24B shows an electrode drive circuit which is designed in consideration of a high-frequency characteristic. In FIG. 24A, the operational amplifier 233 is used to cause a level shift from control voltage to electrode drive voltage, which is supplied to a gate of the n-channel transistor 232. Thus, an electric current is caused to flow from the rotation drum 24 to the n-channel transistor 232, by which the electrode D is driven. The circuit of FIG. 24B is designed such that an output of the inverter 230 is used intentionally to vary flow of the electric current to improve the high-frequency characteristic.

Figure 25A:
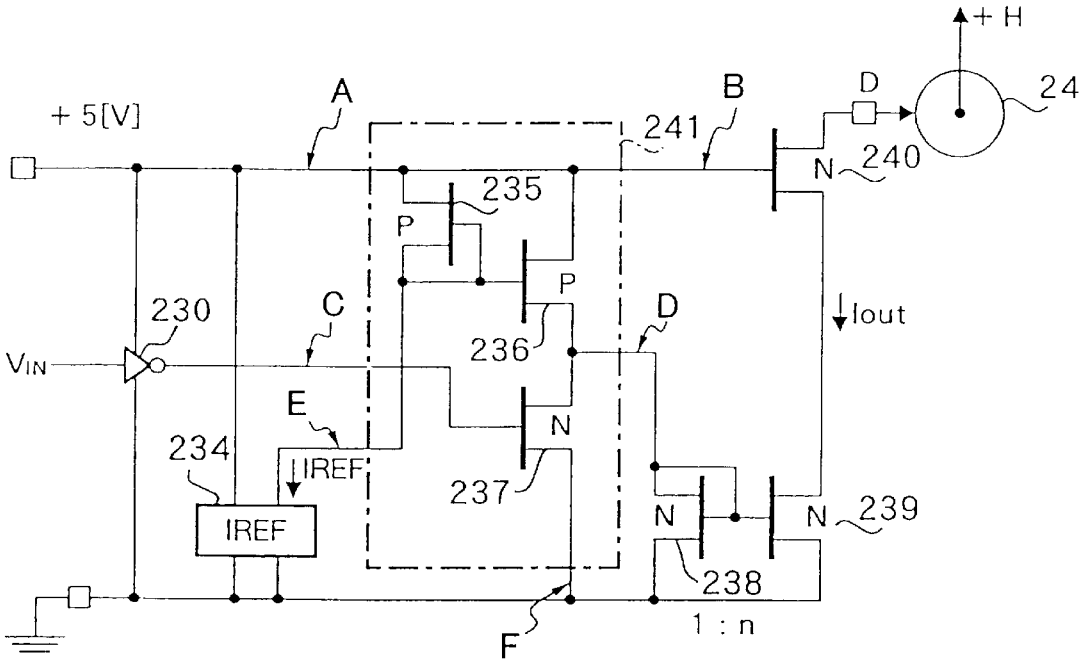
FIG. 25A is a circuit diagram showing an electrode drive circuit using a current reference circuit and being driven by constant current.

FIG. 25A shows an electrode drive circuit using a current reference circuit. Namely, the circuit of FIG. 25A installs a current reference circuit (IREF) 234 to cause smooth level shift from control voltage to electrode drive voltage. Concretely speaking, voltage of an n-channel transistor 239 is increased n times higher than voltage of an n-channel transistor 238.

Figure 25B:
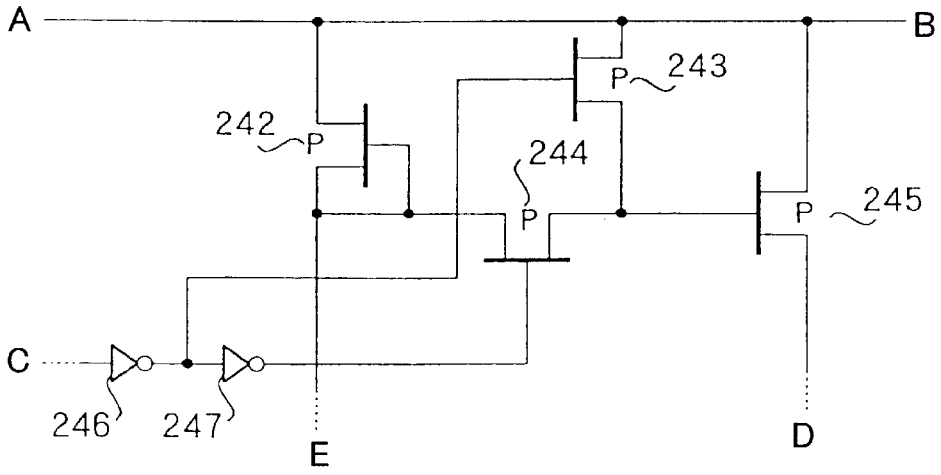
FIG. 25B is a circuit diagram showing essential parts which substitute for a circuit portion encompassed by a dashed line in FIG. 25A.
Figure 26:
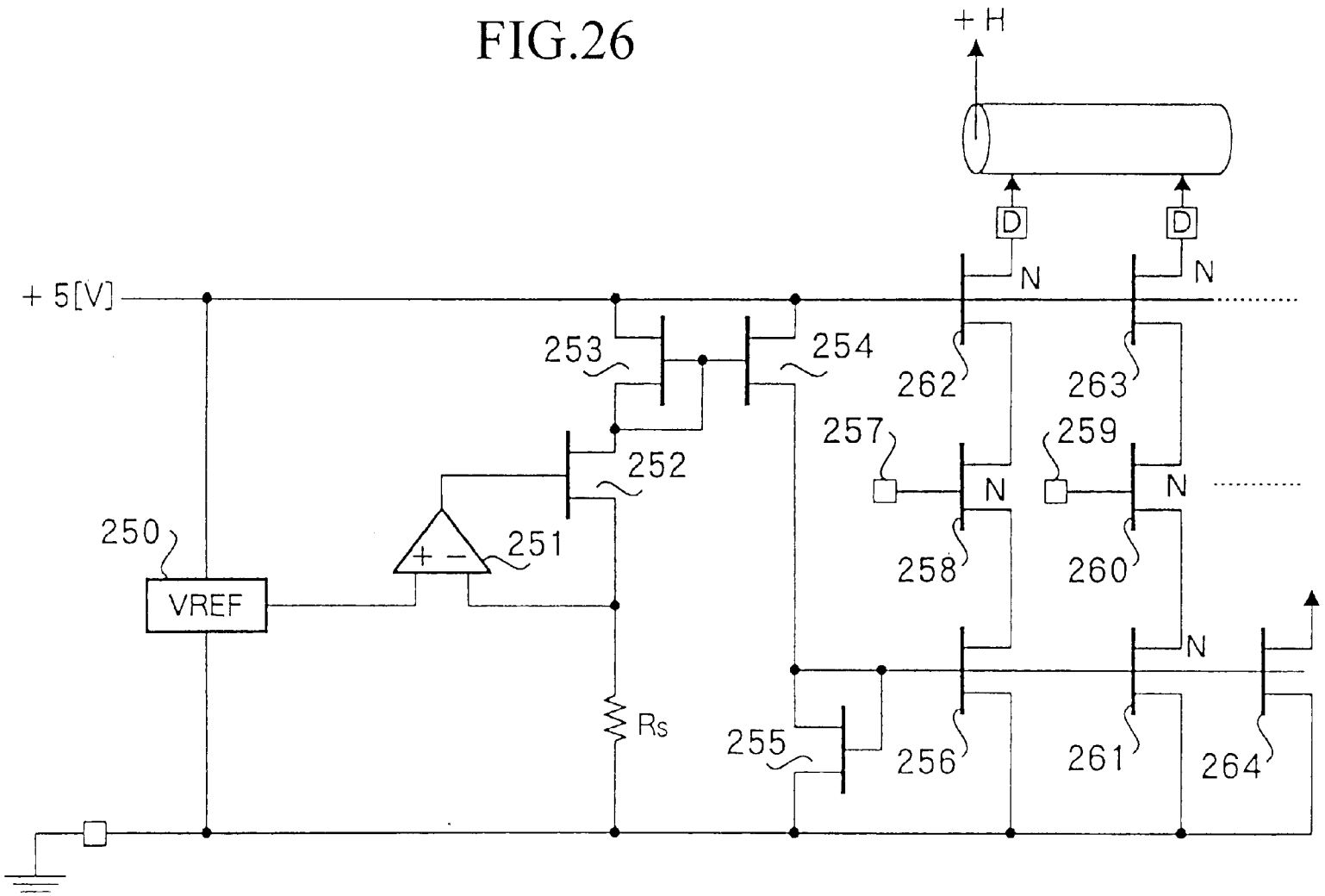
FIG. 26 is a circuit diagram showing an electrode drive circuit using a voltage reference circuit and being driven by constant current.

FIG. 25B shows a modification of the electrode drive circuit shown in FIG. 25A. That is, FIG. 25B shows essential parts for substitution of a circuit portion (including transistors 235, 236, 237) encompassed by a dashed line in FIG. 25A. Herein, circuitry shown in FIG. 25B is substituted for the circuit portion encompassed by the dashed line in FIG. 25A and is connected by way of points A, B, C, D and E. Incidentally, a connection point F shown in FIG. 25A is not used in FIG. 25B. FIG. 26 shows an electrode drive circuit using a voltage reference circuit (VREF) 250 being driven by constant current. The circuit of FIG. 26 is provided for driving two electrodes, which are driven by pulse signals supplied to terminals 257, 259 respectively. In response to the pulse signals, the circuit of FIG. 26 turns on electricity between the electrodes D and the rotation drum 24.

Figure 27A:
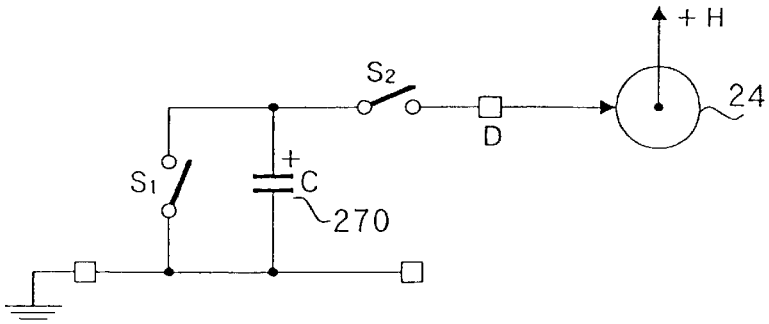
FIG. 27A is a circuit diagram showing a basic configuration of an electrode drive circuit using a switched-capacitor, which is used to explain operating principle.
Figure 27B:
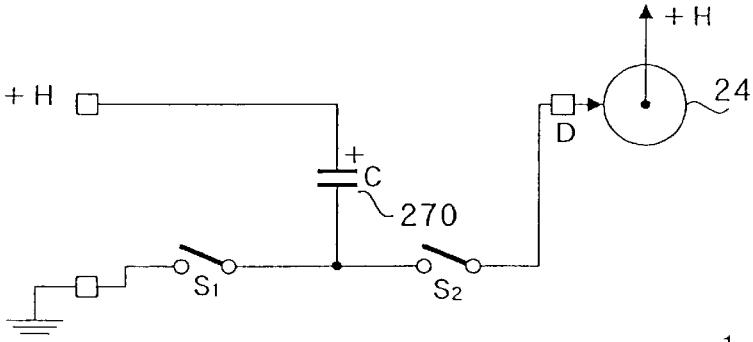
FIG. 27B is a circuit diagram showing a concrete configuration of the electrode drive circuit using the switched-capacitor.
Figure 27C:
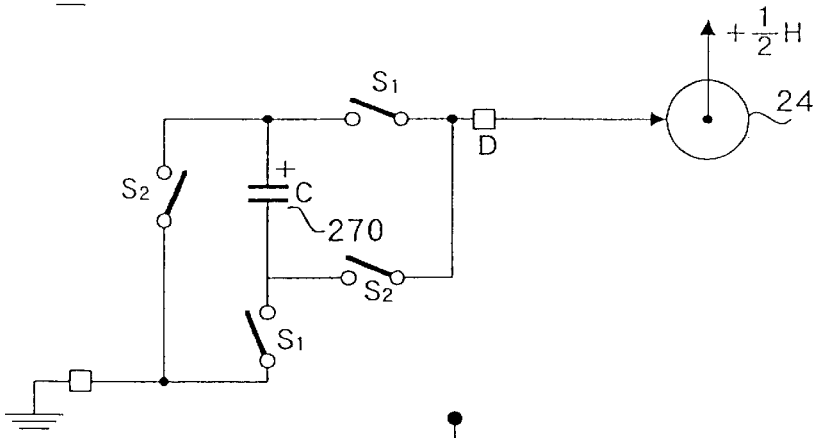
FIG. 27C is a circuit diagram showing a modified example of the electrode drive circuit using the switched-capacitor to double voltage and current in driving an electrode.
Figure 27D:
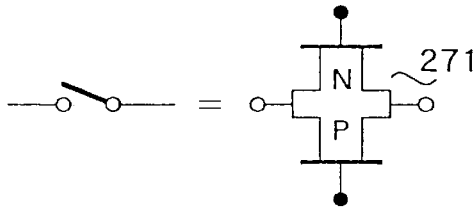
FIG. 27D shows a MOS switch used for the switched-capacitor.

FIGS. 27A to 27E show examples of electrode drive circuits using switched-capacitors. FIG. 27A shows a basic configuration for the electrode drive circuit of a switched-capacitor type. FIG. 27B shows a concrete configuration of the electrode drive circuit of the switched-capacitor type. FIG. 27C shows a configuration of the electrode drive circuit that is designed to double voltage and current in driving the electrode. The circuits of FIGS. 27A to 27C are designed to drive the electrode by using electric charges being accumulated in a capacitor 270. In the circuits of FIGS. 27A and 27B, switches $S_1$ and $S_2$ are alternately turned ON or OFF, in other words, $S_1$ is closed when $S_2$ is open, while $S_1$ is open when $S_2$ is closed. In response to alternate switching of the switches $S_1$ and $S_2$, the circuits turn on electricity between the electrode D and the rotation drum 24. Herein, the circuit of FIG. 27A turns on electricity between the electrode D and the rotation drum 24 such that electric charges are accumulated in the capacitor 270 when the switch $S_1$ is open and the switch $S_2$ is closed. When $S_1$ is closed and $S_2$ is open, electric charges accumulated in the capacitor 270 are released to the ground. Thus, the circuit of FIG. 27A adequately turns on electricity between the electrode D and the rotation drum 24 by repeating the aforementioned operations.

When the switch $S_1$ is open and the switch $S_2$ is closed, the circuit of FIG. 27B turns on electricity between the electrode D and the rotation drum 24 such that electric charges of the capacitor 270 are discharged. Then, when $S_1$ is closed and $S_2$ is open, the electric charges are accumulated in the capacitor 270, so that the capacitor 270 is increased in potential to the voltage of +H. In this case, electricity is not applied between the electrode D and the rotation drum 24. Thereafter, when $S_1$ is open and $S_2$ is closed, the circuit turns on electricity between the electrode D and the rotation drum 24 again such that electric charges of the capacitor 270 are discharged. Thus, the circuit of FIG. 27B adequately turns on electricity between the electrode D and the rotation drum 24 by repeating the aforementioned operations.

The circuit of FIG. 27C includes two sets of the switches $S_1$, $S_2$, wherein two switches $S_1$ are controlled to be simultaneously turned ON or OFF, and two switches $S_2$ are also controlled to be simultaneously turned ON or OFF. Herein, the switches $S_1$ and the switches $S_2$ are alternately turned ON or OFF. That is, both of the switches $S_1$ are closed when both of the switches $S_2$ are open, or both of the switches $S_1$ are open when both of the switches $S_2$ are closed. The capacitor 270 contains two electrodes (or plates), namely, a first electrode (+) and a second electrode (−). When the switches $S_1$ are closed and the switches $S_2$ are open, electric charges are accumulated on the first electrode (+) of the capacitor 270 to be increased in potential to voltage of 1/2H, while the second electrode (−) of the capacitor 270 discharges on the earth. Then, when the switches $S_1$ are open and the switches $S_2$ are closed, the first electrode (+) of the capacitor 270 discharges the electric charges corresponding to the voltage of 1/2H by way of the switch $S_2$, while electric charges are accumulated on the second electrode (−) of the capacitor 270 to be increased in potential up to the voltage of 1/2H. Thus, the circuit of FIG. 27C adequately turns on electricity between the electrode D and the rotation drum 24.

As described above, both of the circuits of FIGS. 27A and 27B do not turn on electricity between the electrode and rotation drum when the switch $S_1$ is closed. In contrast, the circuit of FIG. 27C normally turns on electricity between the electrode and rotation drum in any cases where the switches $S_1$ are closed or the switches $S_2$ are closed. Therefore, even if the circuit of FIG. 27C use a half voltage for the rotation drum as compared with the circuits of FIGS. 27A, 27B, the circuit of FIG. 27C is capable of flowing electric currents in one switching cycle as similar to the circuits of FIGS. 27A, 27B. In general, properties of the aforementioned circuits can be expressed by the following formulae.

$$R=1/(fs\times C)$$

$$Q=C\times V$$

$$Q=I\times T$$

$$T=1/fs$$

$$I=C\times V\times fs$$

Figures 28A, 28B, 28C:
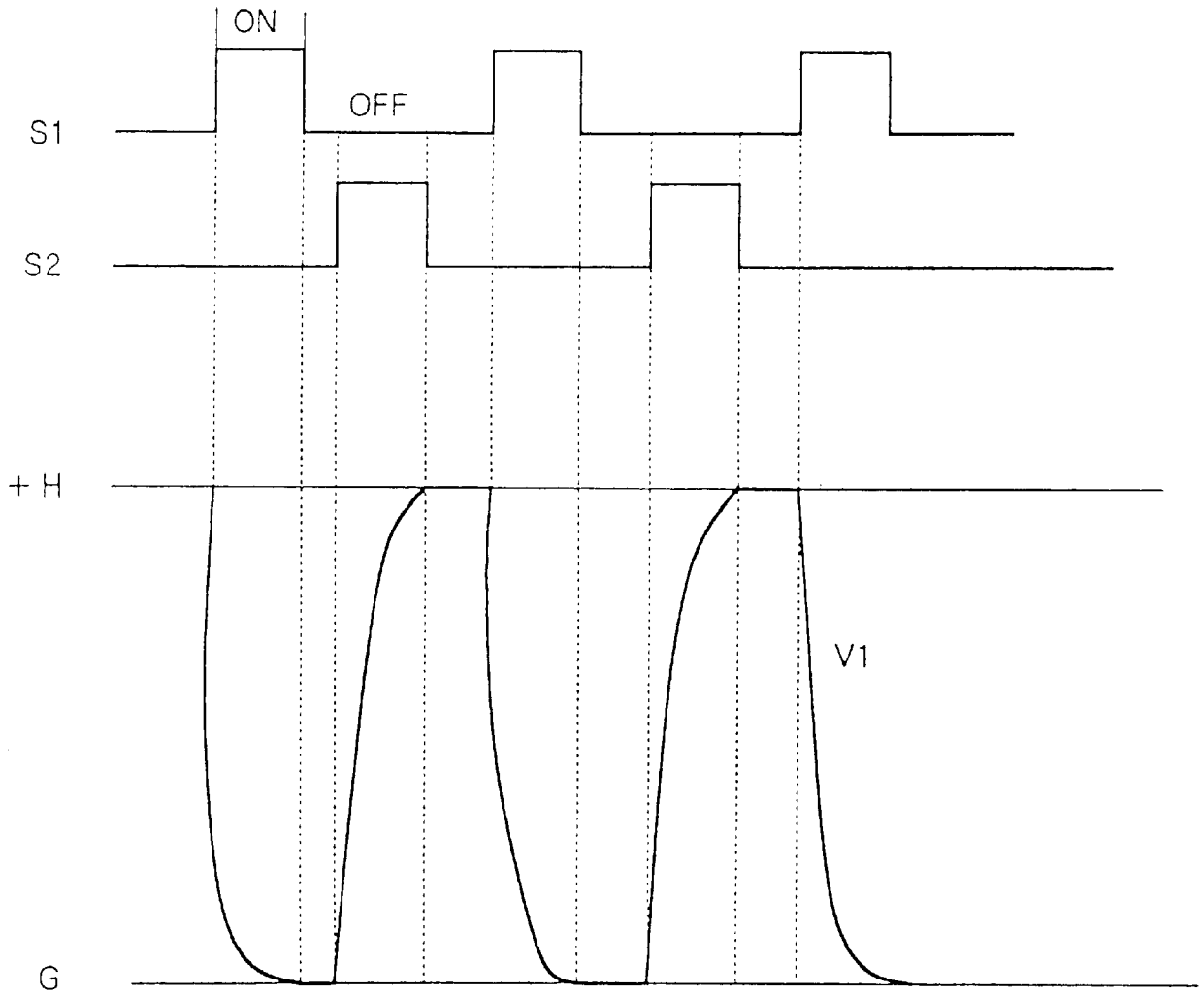
FIG. 28A shows ON/OFF operations of a switch $S_1$.
FIG. 28B shows ON/OFF operations of a switch $S_2$.
FIG. 28C shows a waveform representative of variations of potentials on an electrode of a capacitor being grounded on earth.

Incidentally, the circuit of FIG. 27A is equivalent to the circuit of FIG. 27B. Herein, each of the switches $S_1$, $S_2$ is configured by a MOS switch shown in FIG. 27D. FIGS. 28A to 28C are time charts which are used to explain operations of the circuits of FIGS. 27A, 27B. Actually, FIG. 28C shows variations of potentials on the second electrode (−) of the capacitor 270, which are being grounded on the earth, in response to ON/OFF operations of the switches $S_1$, $S_2$ shown in FIGS. 28A, 28B. Because the aforementioned circuits use the switched-capacitors, a waveform V1 shown in FIG. 28C becomes slightly dull.

Figure 27E:
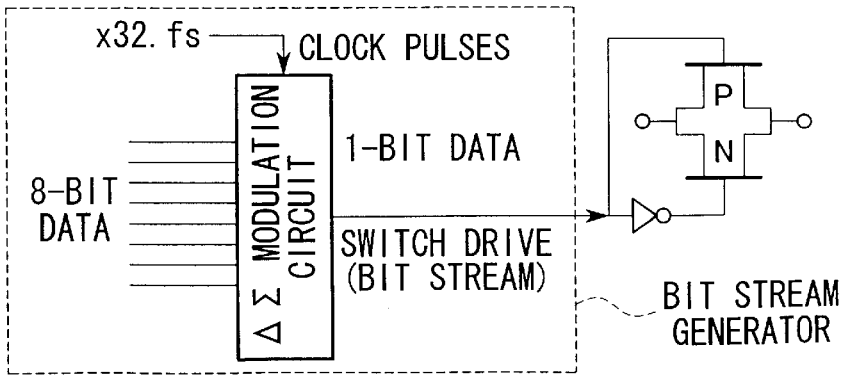
FIG. 27E shows an example of circuitry for turning the MOS switch.

In the aforementioned switched-capacitor, the switch is driven by 1-bit data, which a delta-sigma (ΔΣ) modulation circuit produces by effecting delta-sigma modulation on 8-bit data shown in FIG. 27E. In order to obtain an 8-bit equivalent accuracy in sampling, the delta-sigma modulation circuit needs a high sampling frequency, which is thirty-two times higher than original one. Therefore, the present system performs over-sampling operations using a high clock frequency which is thirty-two times (or n times) higher than original one. The delta-sigma modulation circuit is connected to one terminal of the MOS switch (see FIG. 27D) by way of an inverter. If the switch $S_1$ is configured as shown in FIG. 27E, the switch $S_2$ is actualized by reversing connection of the inverter with the MOS switch.

[B] Second Embodiment

Next, a second embodiment of the invention will be described in detail with reference to FIGS. 29, 30A–30F, 31 and 32. The second embodiment is basically designed such that gradation data or patterns of pulse signals are corrected in response to characteristics of electrodes and papers, and print positions are also corrected in response to installation positions of electrodes. To accomplish the aforementioned corrections, the second embodiment produces correction data based on actual print positions and actual printing densities which are measured.

Figure 29:
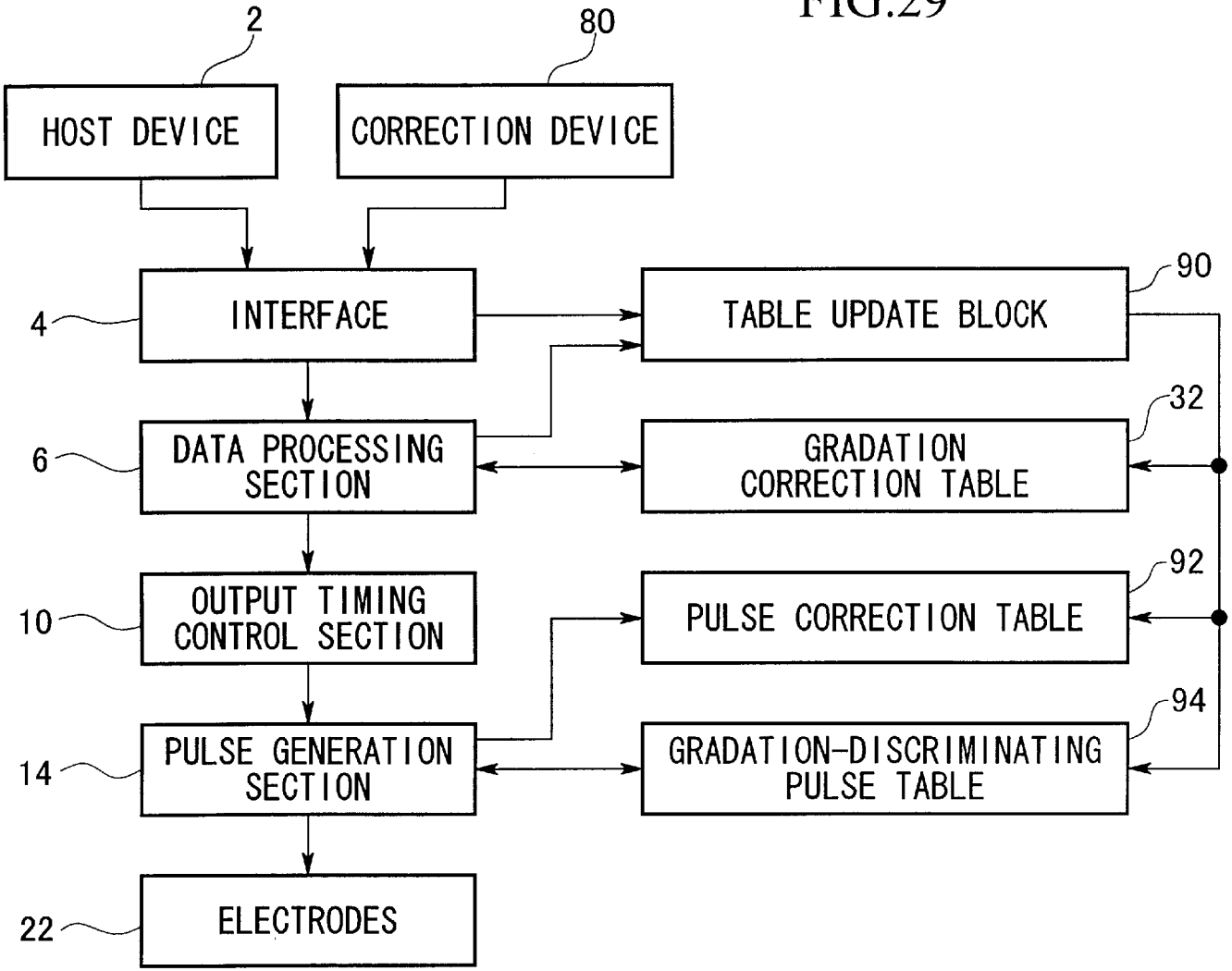
FIG. 29 is a block diagram showing a configuration of an electrode control unit in accordance with a second embodiment of the invention.

FIG. 29 shows a configuration of an electrode control unit in accordance with the second embodiment of the invention, wherein parts equivalent to those shown in FIGS. 2 and 3 are designated by the same reference numerals, hence, the description thereof will be omitted. In FIG. 29, an interface 4 is connected with a correction device (or calibrating device) 80 to input correction information. The electrode control unit installs a table update block 90 for updating contents of tables 32, 92 and 94 when the interface 4 receives the correction information. The second embodiment is characterized by providing three types of tables for corrections. That is, a gradation correction table 32 is coupled with the data processing section 6, while a pulse correction table 92 and gradation-discriminating pulse tables 94 are coupled with the pulse generation section 14. Herein, the pulse correction table 92 is used to correct pulse widths or numbers of pulses included in pulse signals, while the gradation-discriminating pulse tables 94 are used to generate pulse signals in response to gradation values respectively. The second embodiment is basically designed to update all of the tables in response to the correction information. However, it is possible to arbitrarily set and change combinations of the tables. For example, the second embodiment is modified to provide only one table within the aforementioned tables. Or, the second embodiment is equipped with two or more tables, one of which is subjected to updating. In general, the tables are classified into two types of tables, namely, a first table for correcting printing characteristics based on printing methods being employed by electrodes and a second table for correcting a nonlinear characteristic commonly possessed by a certain group of electrodes and for correcting ink characteristics with respect to types of ink respectively. In that case, the two types of the tables are updated in such a way that content of the first table is corrected and updated in manufacture of the printer, and content of the second table is corrected and updated when a user changes ink, for example.

Figures 30A, 30B, 30C, 30D, 30E, 30F:
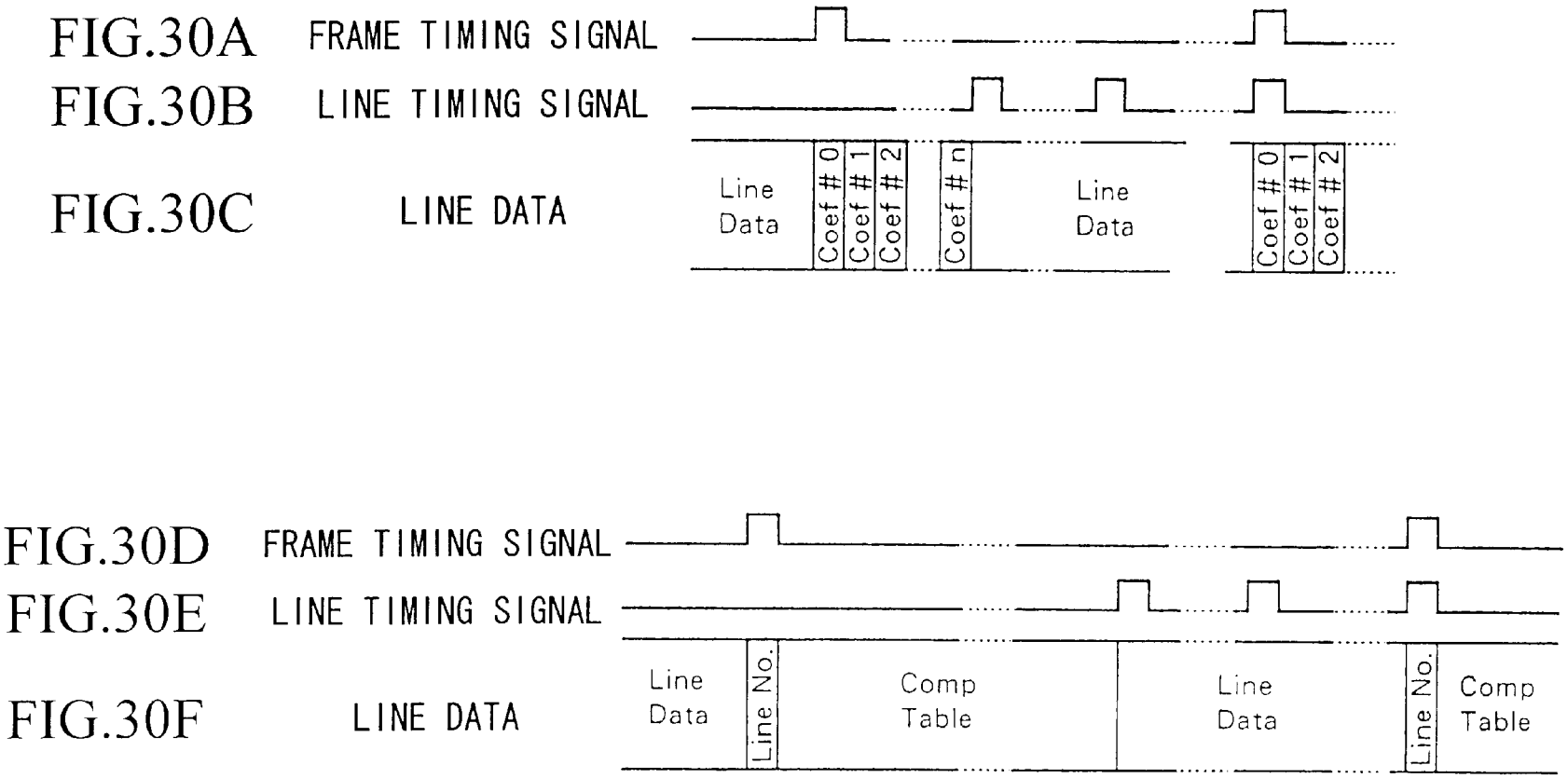
FIG. 30A shows a frame timing signal indicating frames for sequential transfer of line data.
FIG. 30B shows a line timing signal consisting of line timing pulses.
FIG. 30C shows a sequence of data including line data and coefficients for corrections, which are sequentially transferred by each frame.
FIG. 30D shows a frame timing signal indicating frames for sequential transfer of line data.
FIG. 30E shows a line timing signal consisting of line timing pulses.
FIG. 30F shows a sequence of data including line data and table content for corrections, which are sequentially transferred by each frame.

FIGS. 30A to 30F are time charts showing examples of sequences of gradation data and correction data which are multiplexed. Specifically, FIG. 30C shows a sequence of data being produced by multiplexing coefficients used for corrections based on the aforementioned formulae, and FIG. 30F shows a sequence of data being produced by multiplexing contents of reference tables for corrections. Incidentally, gradation correction data are supplied to the electrode control unit of the second embodiment. Herein, the gradation correction data can be sent independently of print data. Due to limitation in a number of input ports of the printer, however, it is possible to send the gradation correction data and print data in a time division manner by using a same port (or same ports). There are two types of gradation corrections, which utilize a conversion equation including a conversion coefficient (or conversion coefficients) and a conversion table respectively. FIG. 30C shows that prior to transfer of line data, conversion coefficients are sequentially transferred to correction circuits regarding all of the electrodes, and FIG. 30F shows that prior to transfer of line data, contents of reference tables are sequentially transferred such that content of a reference table is transferred to a correction circuit of one electrode by each frame.

Figure 31:
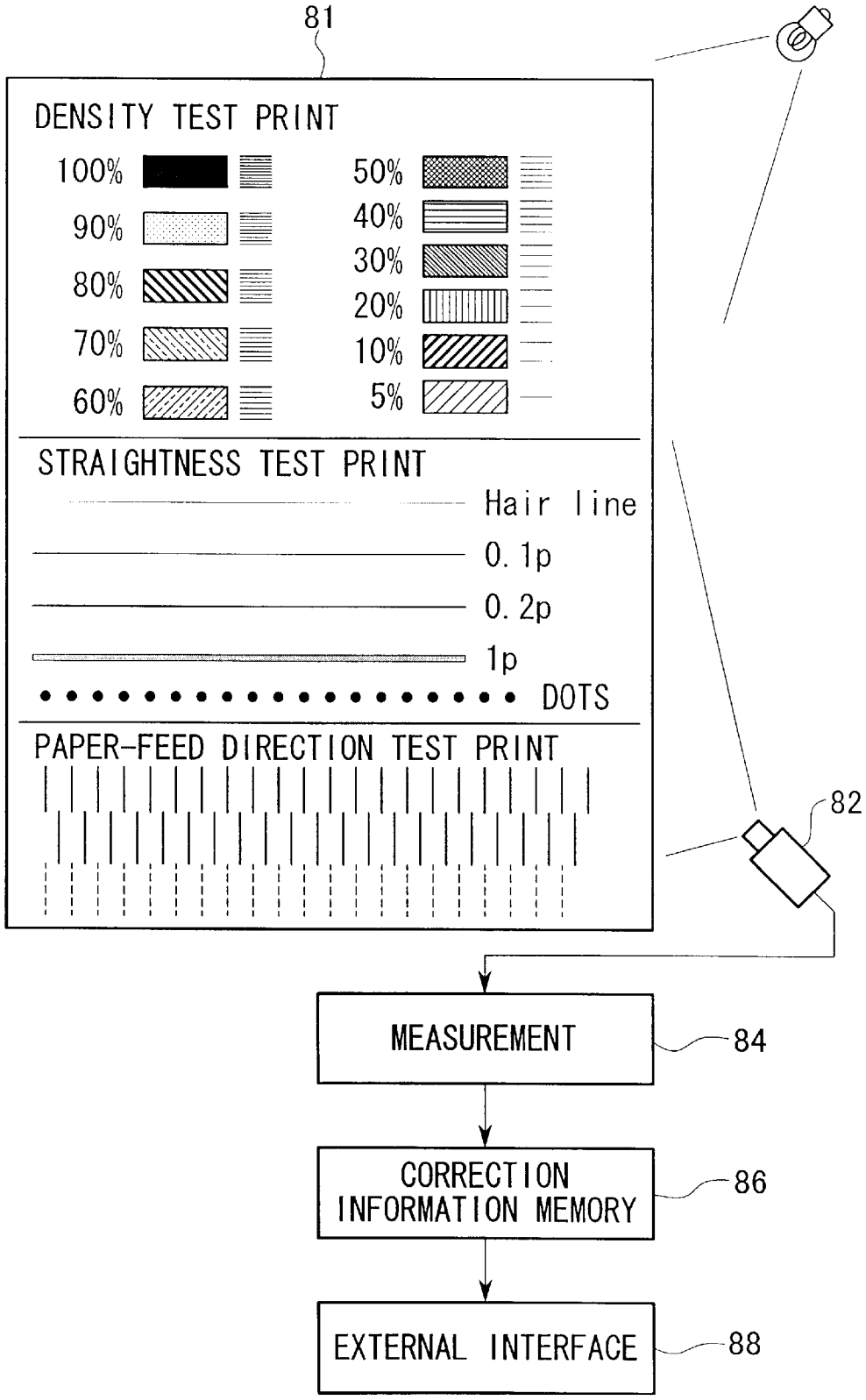
FIG. 31 is a block diagram showing a configuration of a correction device shown in FIG. 29 and a correction print used for measurement.

FIG. 31 shows a configuration of the correction device 80 and an example of print for corrections. The correction device 80 installs a measurement block 84, a correction information memory 86 and an external interface 88. Herein, the measurement block 84 measures a print image of ink dots, which is formed on the rotation drum 24 or a prescribed paper. So, the measurement block 84 produces correction information for correcting gradation values on the basis of the measured print image. The correction information is stored in the correction information memory 86 and is output by way of the external interface 88. In FIG. 31, the correction device 80 uses a correction print 81 on which a test print for corrections is made. So, the correction device 80 is equipped with a camera 82 that photographs the print image on the correction print 81 to produce the correction information. Of course, the corrections are not necessarily performed based on the correction print 81. That is, it is possible to photograph a print image being formed on the rotation drum 24 to produce correction information.

As images being formed on the correction print 81, there are provided a gray-scale print showing variations of gradations from 0% to 100% and a straight-line print showing straight lines which are drawn along an overall width in printing or which are drawn in a paper-feed direction. In the case of color printing in which different sets of electrodes are respectively used for different colors, color dots are printed by the respective electrodes on the correction print 81. Incidentally, a test print in the paper-feed direction is not necessarily made using all the electrodes, so it can be made using a prescribed number (e.g., twenty) of electrodes. As for the gray-scale print, print patters are formed in response to pulse signals that are generated in accordance with gradation values (i.e., 0 to 255) of gradation data respectively. Reading the print images respectively corresponding to the pulse signals, it is possible to obtain information regarding relationships between gradation values and actual printing densities. Due to some reasons such as compatibility between ink and papers, printing densities are not varied linearly in response to gradation values, which is shown in FIG. 11. In that case, the correction device produces non-linear characteristics between printing densities and gradation values on the basis of the aforementioned information. Those characteristics are stored in the form of conversion equations or as content of the conversion table, so that they are adequately used in actual printing.

As shown in FIG. 31, it is possible to draw a set of straight lines which are varied in thickness from a very thin line (i.e., hair line). Based on the thickness and straightness of the lines actually printed, it is possible to correct pulse signals for driving electrodes. In FIG. 31, straight lines are drawn in an alignment direction of the electrodes. In some cases, it is difficult to specify each of the electrodes being corrected on the basis of results of the straight lines drawn in the alignment direction of the electrodes. To cope with such difficulty, a printing test is performed to draw straight lines in a paper-feed direction by using electrodes which are designated. So, it is possible to specify the electrodes being corrected based on results of the straight lines drawn in the paper-feed direction with ease. Incidentally, it is possible to draw straight lines using all the electrodes, so that all electrodes are being corrected. As described before, correction information is not necessarily produced based on the correction print. That is, it is possible to produce correction information by measuring print images formed on the rotation drum inside of the printer. In that case, correction data are produced by feedback control, which is performed to obtain an optimal print result within print results which are produced by sequentially changing pulse widths of the pulse signals for driving the electrodes. Those correction data are updated by the table update block 90 shown in FIG. 29.

Variations in relationships between gradation values and printing densities depend upon relationships between types of ink and papers and are shown by characteristic curves, for example. Those curves do not necessarily depend upon differences in installation positions of electrodes of printers in manufacture. In general, a same curve is applied to all printers using a same type of the electrode control unit. For this reason, one correction data (or correction information) can be commonly shared among plenty of printers. So, it is possible to transmit "common" correction data to the printers by way of communications such as Internet and Intranet. Using the correction data, the table update block 90 shown in FIG. 29 updates contents of tables.

In order to perform color printing, it is preferable that the printer installs an electrode-alignment-direction print position correcting function and a paper-feed-direction print position correcting function. That is, the electrode-alignment-direction print position correcting function moves destinations of pulse signals in an alignment direction of electrodes based on first offset data with respect to each color of ink. In accordance with the paper-feed-direction print position correcting function, the electrode control unit of the printer varies output timing of pulse data based on second offset data with respect to each of electrodes. Using those functions, it is possible to improve reproducibility in color printing while avoiding positional deviations in printing. Thus, it is possible to perform color printing with a high quality. In addition, it is possible to use characteristic curves representing relationships between gradation values and printing densities with respect to colors of ink respectively. Using those curves, it is possible to improve reproducibility in mixture of colors on prints. Thus, it is possible to express rich coloring on dots of prints.

Figure 32:
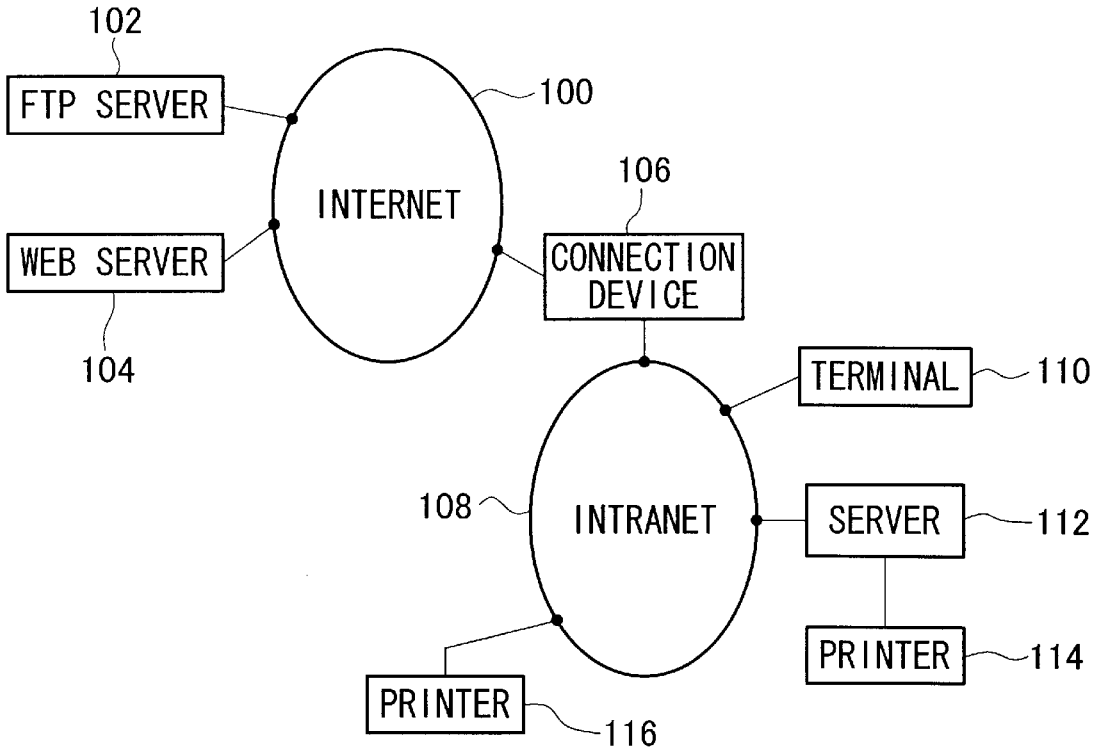
FIG. 32 is a block diagram showing a system for transmitting correction data to printers over networks.

FIG. 32 shows a system for transmission of correction data, which are transmitted to printers over networks. Herein, interfaces of printers receive correction information which are transmitted from host devices over networks. As the correction information which is transmitted over networks, there is provided correction information, which is published by ink producing companies or printing press manufacturing companies and which is determined based on print characteristics of specific ink (e.g., relationships between gradation values and printing densities). In FIG. 32, an Internet 100 identifies terminals in accordance with global IP addresses (where "IP" is an abbreviation for "Internet Protocol"). An Intranet 108 is connected with the Internet 100 by way of a connection device 106 by address conversion to IP addresses. In addition, the Intranet 108 identifies terminals (110) in accordance with private IP addresses therein. FIG. 32 shows two types of printers 114, 116. Herein, the printer 114 is connected with the Intranet 108 by way of a server 112, and the printer 116 having an IP address is directly connected with the Intranet 108.

A user is capable of obtaining correction data by storage media such as CD-ROMs, for example. In that case, the user mounts the CD-ROM on the terminal 110 or server 112, so that the correction data stored in the CD-ROM are transmitted to the printer 114 or 116 over the Intranet 108. In addition, manufacturer of printers is capable of registering new correction data in an FTP server (where "FTP" is an abbreviation for "File Transfer Protocol") 102 or a WEB server (where "WEB" is an abbreviation for "World Wide Web") 104. In that case, the user operates the terminal 110 to access the server 102 or 104 so as to download the new correction data, which are transferred to the printer 114 or 116. In the printer 114 or 116, the table update block updates original correction data with the new correction data. If the printer installs multiple tables for storing correction data, it is necessary to discriminate a desired table in response to a file name or version of the new correction data.

[C] Third Embodiment

Figure 33:
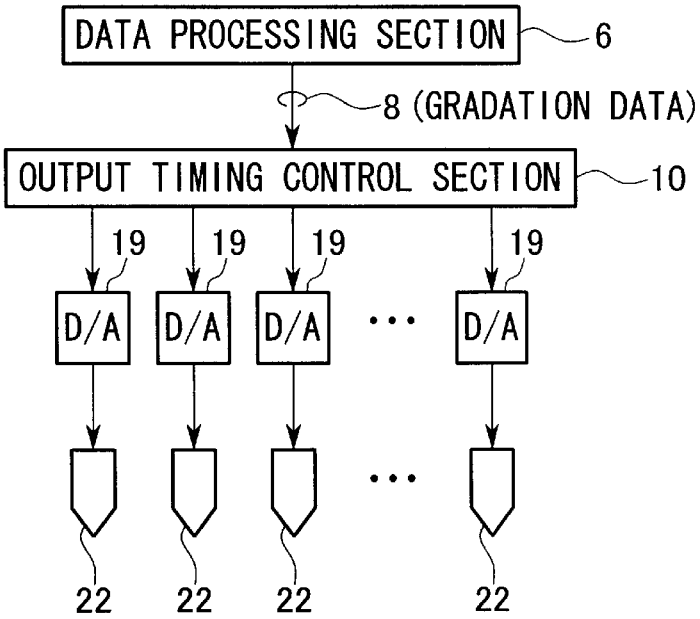
FIG. 33 is a block diagram showing essential parts of an electrode control unit in accordance with a third embodiment of the invention.

Next, a third embodiment of the invention will be described with reference to FIGS. 33, 34A, 34B, 35A, 35B and FIGS. 36A–36L. FIG. 33 shows essential parts of an electrode control unit of the third embodiment. The electrode control unit installs a data processing section 6 and an output timing control section 10 as well as digital-to-analog (D/A) converters 19. Herein, the data processing section 6 receives gradation data representing gradation values by way of an interface (not shown), so that the gradation data are forwarded to the output timing control section 10. The output timing control section 10 controls output timings for outputting the gradation data with respect to one line of electrodes 22 respectively. The D/A converters 19 convert the gradation data, output timings of which are controlled by the output timing control section 10, to analog signals. That is, the third embodiment is characterized by that pulse signals are not generated based on the gradation data but analog signals for driving the electrodes 22 are directly generated from the gradation data. To secure linearity in printing in an alignment direction of the electrodes 22, the third embodiment installs the D/A converters 19, which are arranged in parallel and a number of which corresponds to a number of the electrodes 22. That is, the output timing control section 10 outputs the gradation data in parallel, so that the D/A converters 19 are activated to drive the electrodes 22.

Figure 34A:
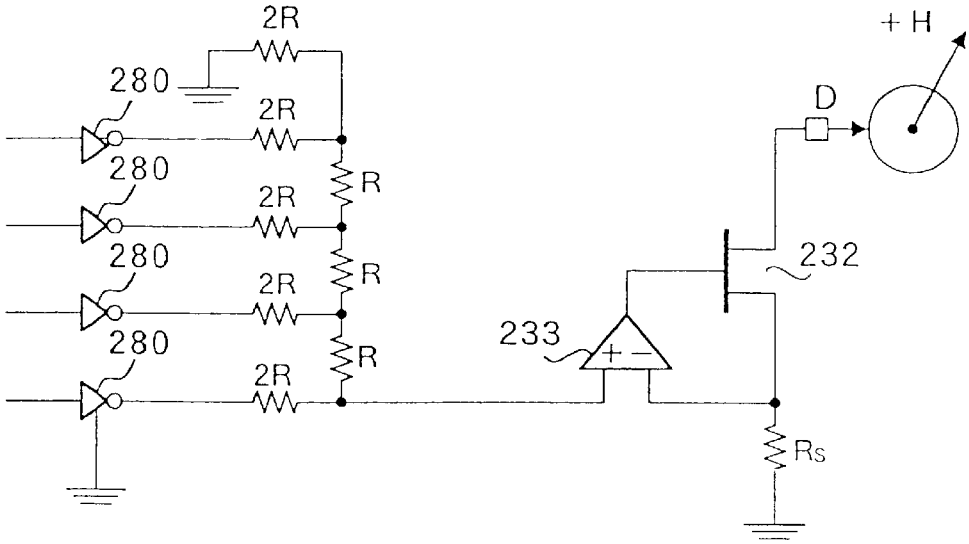
FIG. 34A is a circuit diagram showing an example of a D/A converter of a voltage output type.
Figure 34B:
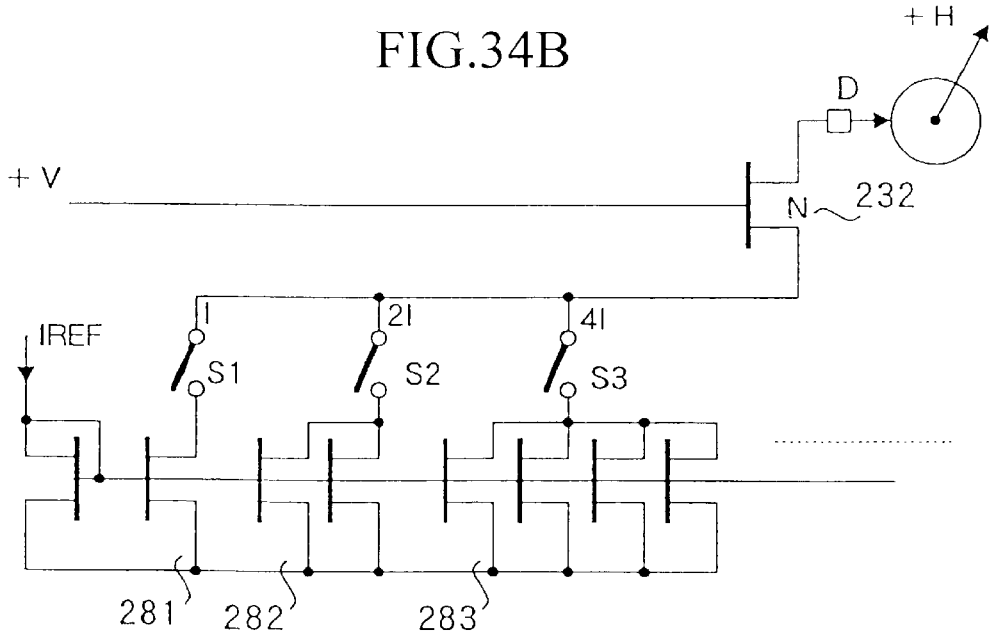
FIG. 34B is a circuit diagram showing an example of a D/A converter of a current output type.
Figure 35A:
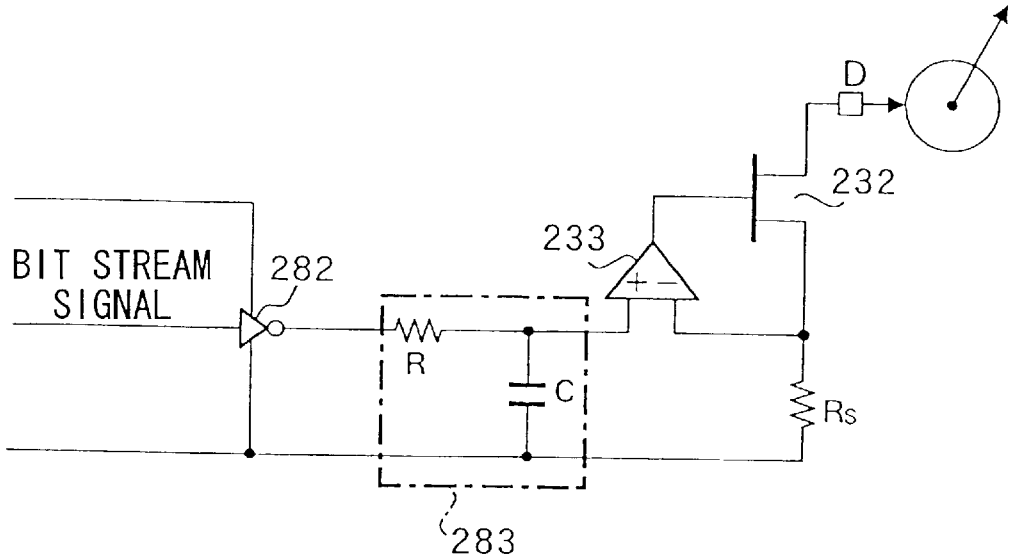
FIG. 35A is a circuit diagram showing another example of a D/A converter of a voltage output type.
Figure 35B:
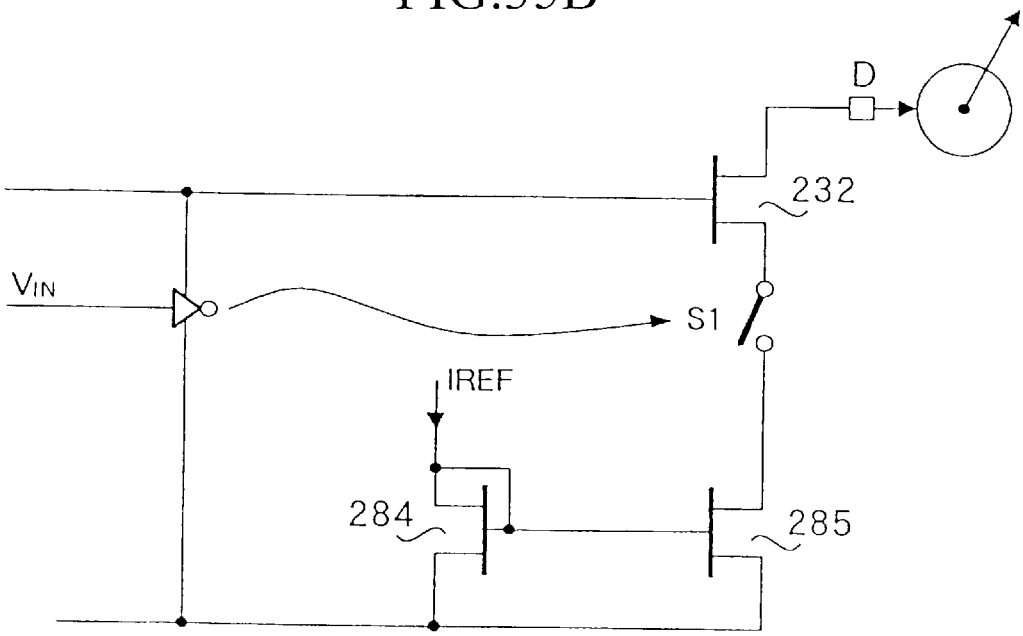
FIG. 35B is a circuit diagram showing another example of a D/A converter of a current output type.
Figure 37A:
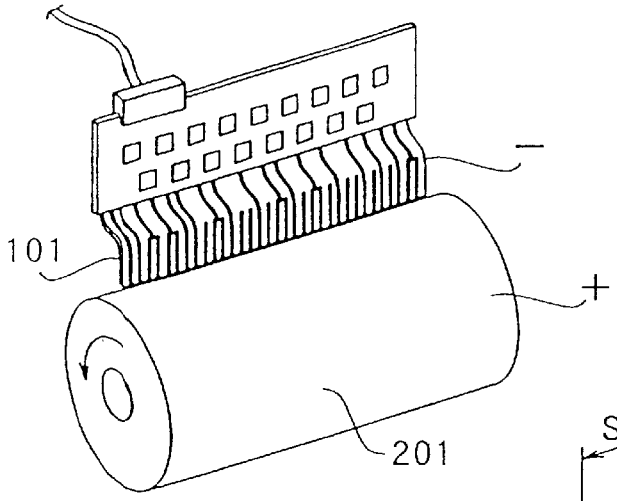
FIG. 37A is a perspective view showing essential parts of an electro-coagulation printer using a fine pitch electrode unit and a rotation drum.
Figure 37B:
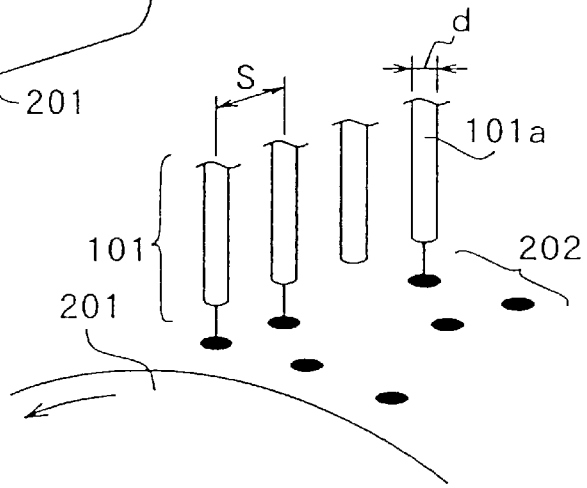
FIG. 37B is an enlarged view showing formation of ink dots by electricity being applied to electrodes.
Figure 37C:
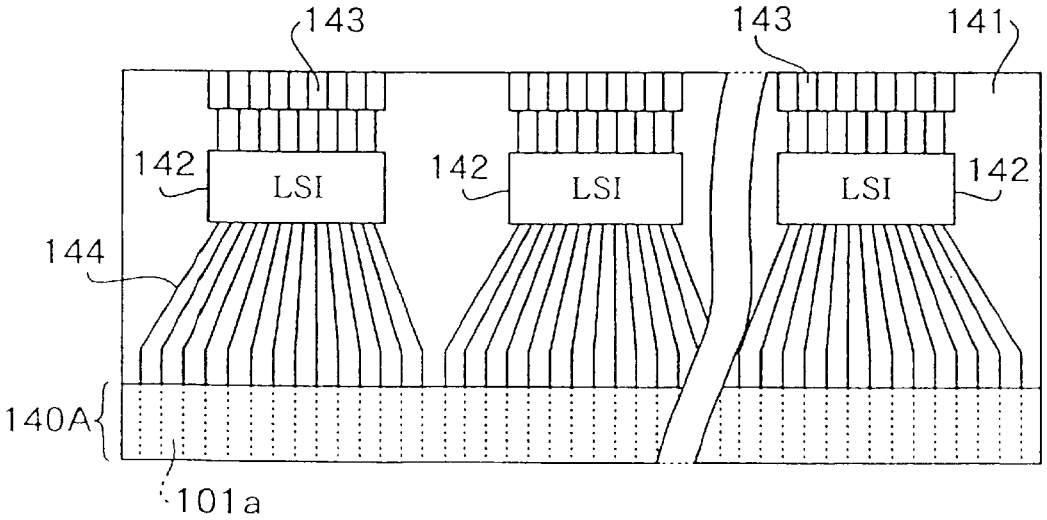
FIG. 37C is a plan view diagrammatically showing a configuration of the fine pitch electrode unit.
Figure 38A:
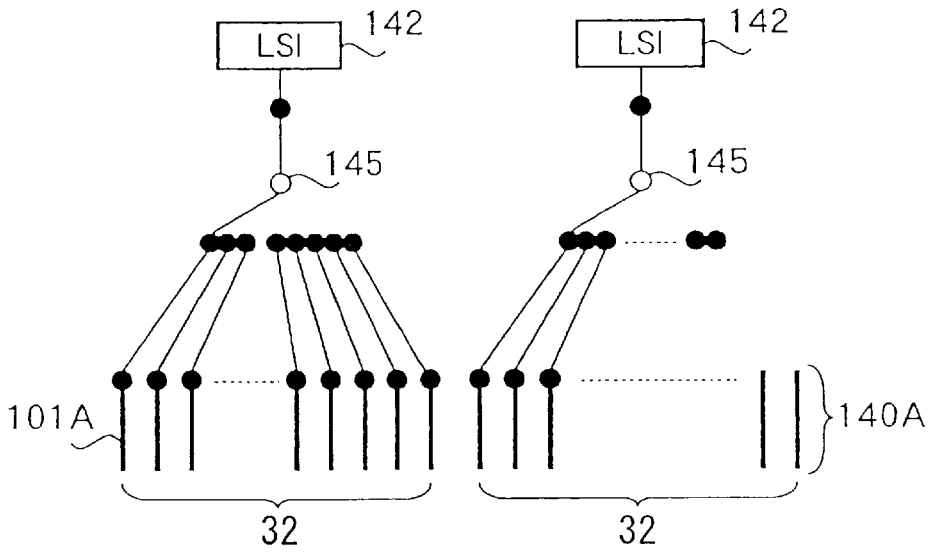
FIG. 38A is a simplified circuit diagram showing connections between LSI circuits, switches and electrodes in the fine pitch electrode unit.
Figure 38B:
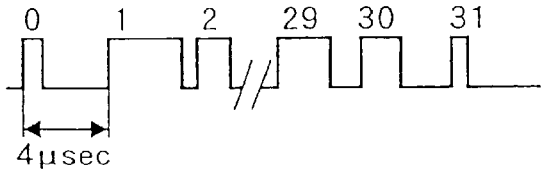
FIG. 38B shows a pulse signal consisting of pulses for driving the electrodes.
Figure 38C:
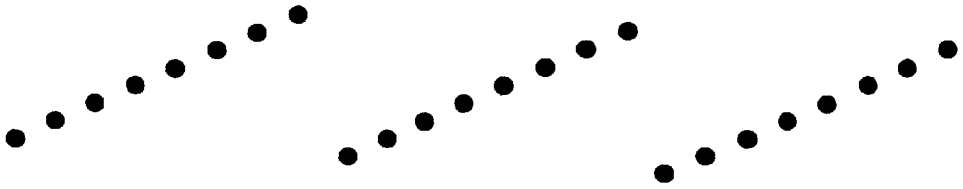
FIG. 38C shows arrangements of ink dots being coagulated in response to the conventional electrode driving method.

FIGS. 34A and 34B show concrete examples of circuit configurations used for the D/A converters 19. Specifically, FIG. 34A shows a D/A converter of a voltage output type, which is equipped with flip-flop circuits (not shown) for retaining 8-bit gradation data prior to inputs 280. The inputs 280 for receiving the gradation data output from the flip-flop circuits are connected to a noninverting input of an operational amplifier 233 by way of resistors 2R, R. The operational amplifier 233 is coupled with a transistor 232 to amplify voltage corresponding to the gradation data, so that an analog signal is generated to drive an electrode D. FIG. 34B shows a D/A converter of a current output type, which is configured using switches S1–S3 and transistors 232, 281–283. FIGS. 35A, 35 show other examples of circuit configurations for the D/A converters 19. That is, FIG. 35A shows a D/A converter of a voltage output type, which inputs gradation data as a bit stream signal produced by a delta-sigma modulation circuit, for example. The bit stream signal input to an inverter 282 is forwarded to an operational amplifier 233 by way of a low-pass filter 283. Thus, it is possible to produce an analog signal based on the gradation data. FIG. 35B shows a D/A converter of a current output type that is configured using an inverter, transistors 232, 284, 285 and a switch $S_1$. Incidentally, it is possible to drive a switched-capacitor by using a bit stream signal, which is produced by a bit stream generator shown in FIG. 27E, for example.

[D] Fourth Embodiment

Next, a fourth embodiment of the invention will be described, particularly with respect to generation of pulse signals. There is a probability in that if all of 8192 electrodes are simultaneously driven, electric currents concentrate in the electrode control unit and the power source becomes unstable. To cope with such a disadvantage, it is possible to differ timings of generating pulse signals by utilizing clock pulses of multiple phases so that all the electrodes will not be simultaneously driven. In the case where pulse signals are generated in proportion to gradation values by constant voltage or constant current, it is possible to avoid concentration of electric power being used for generation of pulse signals by differing the pulse signals in phases between adjacent electrodes. That is, the fourth embodiment is characterized by that the pulse generation section 14 is capable of generating pulse signals having multiple kinds of phases respectively.

FIGS. 36A to 36L are time charts showing examples of pulse signals being generated by the fourth embodiment. Specifically, FIGS. 36A to 36D show examples of pulse signals, which are generated using two kinds of phases alternately. In the foregoing first embodiment, FIGS. 6D to 6G show all of the pulse signals for the electrodes #1FFF to #1FFC are generated using the same phase. In contrast, pulse signals n, n+2 (see FIGS. 36A, 36C) are generated using a first phase, while pulse signals n+1, n+3 (see FIGS. 36B, 36D) are generated using a second phase. That is, there are provided two groups of pulse signals, phases of which differ from each other.

FIGS. 36E to 36H show examples of pulse signals respectively having different phases, which are generated for a prescribed group of electrodes. That is, all the electrodes are classified into groups each consisting of some (e.g., four) electrodes, phases of which differ from each other. In the case of FIGS. 36A–36D, electric power for driving the electrodes is deconcentrated because electric currents are concentrated at each of two groups of electrodes. In the case of FIGS. 36E–36H, it is possible to further deconcentrate the electric power for driving the electrodes.

FIGS. 36I to 36L show examples of pulse signals, which are generated using the original clock signal and more fine clock signal having a fine period. That is, each of the pulse signals consists of pulses, which partly overlap with each other in pulse duration but leading edges of which slightly differ from each other.

As described above, FIGS. 36A to 36D provide two kinds of phases for generation of pulse signals to deconcentrate electric power for driving the electrodes. FIGS. 36E to 36H provide a more number of phases for generation of pulse signals, hence, it is possible to further deconcentrate the electric power being used for driving the electrodes. If all the electrode control circuits are driven using a same clock signal, variations of electric currents used for driving the electrodes become maximal at leading edges of clock pulses. Therefore, it is possible to propose shifting of clock signals for driving the electrode control circuits (or electrode control units) so that variations of electric currents can be reduced in maximal values.

If the electrodes are arranged in a zigzag manner or sawtooth manner while each of delay circuits 50 (see FIG. 15) has a delay value which is a half of a period of the line timing signal, a first-half number of electrodes and a second-half number of electrodes are alternately driven, so it is possible to avoid concentration of electric power in driving the electrodes. If the electrodes are arranged in the sawtooth manner, it is possible to divide the electrodes into a further number of groups, each consisting of electrodes being driven at prescribed timing(s). This actualizes further deconcentration of electric power in driving the electrodes.

As described heretofore, this invention has a variety of technical features and effects, which are summarized as follows:

(1) This invention is basically related to an apparatus and method for electro-coagulation printing, in which ink dots are coagulated on a surface of a rotation drum and are transferred onto a paper. Herein, a parallel conversion step is provided to convert one line of gradation values to parallel data. That is, the gradation values originally input in a serial manner are output onto a parallel bus with respect to electrodes respectively. In addition, a gradation hold step holds the gradation values until one line of gradation values are completely retained. Then, a parallel drive control step simultaneously outputs one line of the gradation values. An electrode drive step simultaneously inputs the gradation values to simultaneously drive the corresponding electrodes. Thus, even if the rotation drum rotates at a high speed, it is possible to secure linearity in printing in an alignment direction of the electrodes.

(2) The electrode drive step controls and drives the electrodes independently based on the gradation values. Thus, it is possible to correct outputs of the gradation values and their output timings with ease. So, even if positional deviations are included in installation positions of the electrodes, it is possible to absorb the positional deviations by corrections being effected on the outputs of the gradation values and their output timings.

(3) Inputting the gradation values in parallel, the electrode drive step drives the electrodes independently based on the gradation values. Hence, it is possible to easily correct the gradation values with respect to the electrodes respectively. That is, it is possible to easily correct the electrodes being driven based on relationships between the gradation values and actual printing densities. As a result, this invention provides a brand-new superior printing method that is capable of performing printing with a high quality and at a high speed by improving linearity in printing as well as physical representations of gradations on papers.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An electro-coagulation printer which comprises a rotation drum adapted to hold a conductive ink film on its surface, a plurality of electrodes configured to when electrifying partially coagulate the conductive ink film to form ink dots on the surface of the rotation drum and a transfer section for transferring the ink dots onto a paper, said electro-coagulation printer comprising:

an interface for receiving print data from an external device;

a data processing section for creating gradation data corresponding to a collection of gradation values designating gradations for pixels on the basis of the print data;

an output timing control section for controlling output timings of one line of the gradation values with respect to the electrodes respectively;

a pulse generation section for receiving the gradation values whose output timings are controlled by the output timing control section and for generating pulse signals in response to the gradation values respectively; and an electrode drive section for driving the electrodes in parallel in response to the pulse signals respectively.

2. An electro-coagulation printer according to claim 1 wherein the pulse generation section installs conversion circuits for generating the pulse signals each consisting of pulses, pulse widths of which depend on a minimal gradation value within the gradation values and a number of which corresponds to each of the gradation values.

3. An electro-coagulation printer according to claim 1 wherein the pulse generation section installs conversion circuits for generating the pulse signals each consisting of a single pulse, a pulse width of which corresponds to each of the gradation values.

4. An electro-coagulation printer according to claim 1 wherein the data processing section installs a gradation correction block for correcting the gradation values based on relationships between amounts of electric power being applied to the electrodes and densities in printing using the ink dots being transferred onto the paper.

5. An electro-coagulation printer according to claim 1 wherein the pulse generation section is equipped in parallel with gradation-discriminating pulse correction circuits for correcting the pulse signals to match with actual densities based on relationships between amounts of electric power being applied to the electrodes and the densities in printing using the ink dots being transferred onto the paper.

6. An electro-coagulation printer according to claim 1 wherein the data processing section installs a data expansion block for expanding the print data to create the gradation data and a timing signal generation block for generating a line timing signal designating a print start timing with respect to each line of the gradation data, and wherein the output timing control section installs a serial-parallel conversion block for converting the gradation data to parallel data whose number corresponds to a number of the electrodes and a gradation data hold block having one line of hold circuits, a number of which corresponds to the number of the electrodes and which hold the gradation values corresponding to the parallel data respectively, so that the gradation data hold block outputs one line of the gradation values in parallel on the basis of the line timing signal.

7. An electro-coagulation printer according to claim 6 wherein the data expansion block outputs "n" gradation data representing gradation values (where "n" is an integer greater than "1") so that the gradation data hold block receives the "n" gradation data in parallel by way of the serial-parallel converter, and wherein the gradation data hold block installs "n" hold circuits with respect to one line of "n" electrodes respectively so that the "n" hold circuits completely hold the "n" gradation data to send them in parallel to the pulse generation section.

8. An electro-coagulation printer according to claim 6 wherein the serial-parallel conversion block has an electrode-alignment-direction print position correcting function to change destinations of the gradation data based on a prescribed first offset in an electrode-alignment direction in which the electrodes are aligned in one line.

9. An electro-coagulation printer according to claim 6 wherein the gradation data hold block has a paper-feed-direction print position correcting function to change timings of outputting one line of the gradation values based on a prescribed second offset, so that the hold circuits output the gradation values in parallel at specific timings which are shifted from the line timing signal.

10. An electro-coagulation printer according to claim 1 wherein the electrode drive section installs a plurality of constant voltage drive circuits, which supply the electrodes with drive signals of a prescribed constant voltage in response to the pulse signals output from the pulse generation section.

11. An electro-coagulation printer according to claim 1 wherein the electrode drive section installs a plurality of constant current drive circuits, which supply the electrodes with drive signals of a constant current in response to the pulse signals output from the pulse generation section.

12. An electro-coagulation printer according to claim 1 wherein the electrode drive section installs a plurality of electrode drive circuits, each of which contains a switched capacitor in which a capacitor accumulates a prescribed amount of electric charges for driving an electrode so that a switch is operated to control timings of charging and discharging the capacitor.

13. An electro-coagulation printer according to claim 1 wherein the interface is equipped in parallel with a calibrating device which comprises a measurement block for reading gradation of an image formed by the ink dots on the rotation drum or paper so as to produce correction information for correcting the gradation values, a correction information memory for storing the correction information and an external interface for outputting the correction information stored in the correction information memory.

14. An electro-coagulation printer comprising:

an interface for receiving print data from an external device;

a data processing section for creating gradation data corresponding to a collection of gradation values for pixels with reference to a table based on the print data;

an output timing control section for controlling output timings with respect to one line of electrodes respectively;

a pulse generation section for generating a plurality of pulse signals for driving the electrodes respectively with reference to a table based on the gradation values;

an electrode drive section for driving the electrodes in parallel independently in response to the pulse signals; and an table update block for updating contents of the tables in response to correction information, which is received by the interface.

15. An electro-coagulation printer according to claim 14 wherein the interface receives the correction information from a host device by way of a network, and wherein the correction information represent a printing characteristic of a specific type of ink, content of which is published by an ink manufacturing company or an printing press manufacturing company and which is made based on relationships between gradation values and actual printing densities.

16. An electro-coagulation printer comprising:

a rotation drum adapted to have a conductive ink film on a surface thereof;

a plurality of electrodes configured to when electrifying partially coagulate the conductive ink film to form ink dots on the surface of the rotation drum;

a transfer section for transferring the ink dots onto a paper;

an interface for receiving print data from an external device;

a data processing section for creating gradation data corresponding to a collection of gradation values for pixels on the basis of the print data;

an output timing control section for controlling timings of outputting the gradation values to one line of the electrodes independently; and an electrode drive section for installing a plurality of D/A converters for converting the gradation values, which are output by the timings independently controlled by the output timing control section, to analog signals, which are output in parallel to drive the electrodes respectively.

17. An electro-coagulation printer comprising:

a rotation drum adapted to have a conductive ink film on a surface thereof;

a plurality of electrodes configured when electrifying partially coagulate the conductive ink film to form ink dots on the surface of the rotation drum;

a transfer section for transferring the ink dots onto a paper;

an interface for receiving print data from an external device;

a data processing section for creating gradation data corresponding to a collection of gradation values for pixels on the basis of the print data;

an output timing control section for controlling timings of outputting the gradation values to one line of the electrodes independently;

a pulse generation section for generating pulse signals for driving the electrodes independently on the basis of the gradation values which are output by the timings independently controlled by the output timing control section; and an electrode drive section for driving the electrodes in parallel based on the pulse signals respectively, wherein the pulse generation section generates the pulse signals having multiple types of phases respectively.

* * * * *